US010668729B2

(12) United States Patent
Iida

(10) Patent No.: US 10,668,729 B2
(45) Date of Patent: Jun. 2, 2020

(54) PRINTER

(71) Applicant: BROTHER KOGYO KABUSHIKI KAISHA, Nagoya-shi, Aichi-ken (JP)

(72) Inventor: Shotaro Iida, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/984,887

(22) Filed: May 21, 2018

(65) Prior Publication Data

US 2018/0264820 A1 Sep. 20, 2018

Related U.S. Application Data

(63) Continuation of application No. 15/456,858, filed on Mar. 13, 2017, now Pat. No. 9,975,343.

(30) Foreign Application Priority Data

Mar. 14, 2016 (JP) ..... 2016-049552

(51) Int. Cl.
*B41J 2/165* (2006.01)

(52) U.S. Cl.
CPC ..... *B41J 2/16523* (2013.01); *B41J 2/1652* (2013.01); *B41J 2/16511* (2013.01); (Continued)

(58) Field of Classification Search
CPC ..... B41J 2/16523; B41J 2/16538; B41J 2/16532; B41J 2/16511; B41J 2/1652; B41J 2/16517; B41J 2/16526; B41J 2002/16573
See application file for complete search history.

(56) References Cited

U.S. PATENT DOCUMENTS 5,801,736 A 9/1998 Ikkatai et al.
6,276,784 B1 * 8/2001 Ikkatai ..... B41J 2/1652 347/85
2007/0291075 A1 12/2007 Mizoguchi et al.

FOREIGN PATENT DOCUMENTS

JP 2007-268806 A 10/2007
JP 2007-331342 A 12/2007
(Continued)

OTHER PUBLICATIONS

IP.com search (Year: 2019).*
(Continued)

*Primary Examiner* — Lisa Solomon
(74) *Attorney, Agent, or Firm* — Scully Scott Murphy and Presser

(57) ABSTRACT

There is provided a printer including: a liquid jetting head; a receiving section; a waste-liquid storing section; a connecting channel connecting the receiving section and the waste-liquid storing section; a pump; and a controller. The controller executes: printing; recovering nozzles; discharging the liquid, which is present in at least one of the receiving section and the connecting channel, to the waste-liquid storing section, after the recovering of the nozzles. Under a condition that there is no input of the print data before the discharging of the liquid, the controller executes the discharging of the liquid continuously after the recovering of the nozzles; under a condition that there is an input of the print data before the discharging of the liquid, the controller executes the printing after the recovering of the nozzles and then executes at least a part of the discharging of the liquid after the printing.

15 Claims, 11 Drawing Sheets

(52) U.S. Cl.
CPC ..... *B41J 2/16517* (2013.01); *B41J 2/16526* (2013.01); *B41J 2/16532* (2013.01); *B41J 2/16538* (2013.01); *B41J 2002/16573* (2013.01)

(56) References Cited

FOREIGN PATENT DOCUMENTS

| | | | |
|---|---|---|---|
| JP | 2008-132690 | A | 6/2008 |
| JP | 2010-017993 | A | 1/2010 |
| JP | 2010-184502 | A | 8/2010 |

OTHER PUBLICATIONS

Machine Translation of JP-2010-184502 A obtained from J-PlatPat of the JPO.
Notice of Allowance dated Jan. 22, 2018 from parent U.S. Appl. No. 15/456,858.
Official Action dated Jan. 7, 2020 received from the Japanese Patent Office in related application JP 2016-049552 together with an English language translation.

* cited by examiner (FULL MAINTENANCE PROCESSING)

BK SUCTION PURGE OPERATION

CL SUCTION PURGE OPERATION

BK IDLE SUCTION OPERATION

CL IDLE SUCTION OPERATION

FLUSHING OPERATION

CHANNEL CLEANING OPERATION

OPENING OF PUMP-TO-ATMOSPHERE OPERATION

CAPPING OPERATION (PROCESSING FOR DETERMINING WHETHER OR NOT PERIODIC MAINTENANCE PROCESSING IS TO BE EXECUTED)

(PRE-PRINT MAINTENANCE PROCESSING)

PRINTER

CROSS REFERENCE TO RELATED APPLICATION

The present application is a continuation application of U.S. patent application Ser. No. 15/456,858 filed on Mar. 13, 2017 and claims priority from Japanese Patent Application No. 2016-049552 filed on Mar. 14, 2016, the disclosure of each of which are incorporated herein by reference in its entirety.

BACKGROUND

Field of the Invention

The present invention relates to a printer which performs a print processing by jetting a liquid from a nozzle.

Description of the Related Art

There is known a printer capable of executing a maintenance processing including a nozzle recovery operation for causing nozzles of a liquid jetting head to discharge a liquid, a discharge operation for sucking the liquid discharged by the nozzle recovery operation by a pump and discharging the sucked liquid to a waste-liquid storing section, etc. For example, there is known a printer which is configured to perform the discharge operation (idle suction operation) continuously after performing the nozzle recovery operation.

SUMMARY

In a printer, in a case that the maintenance processing is performed before the print processing, it is desired that the shift from the maintenance processing to the print processing is performed as quick as possible. However, in the above-described printer, the nozzle recovery operation and the discharge operation are continuously performed, regardless of the presence or absence of a print data, and thus the print processing is not performed until the maintenance processing is completed. Although the print processing can be performed once the nozzle recovery operation is finished, it is necessary to wait for the discharge operation to be completed and to start the print processing, and thus the start of the print processing is delayed by a time required for completing the discharge processing. Thus, it is not possible to execute the print processing quickly.

The present teaching has been made in view of the above-described situation, and an object of the present teaching is to provide a printer capable of shifting from the maintenance processing to the print processing quickly.

According to an aspect of the present teaching, there is provided a printer including:

a liquid jetting head having a plurality of nozzles;

a receiver;

a waste-liquid storage;

a connection channel connecting the receiver and the waste-liquid storage;

a pump provided on the connection channel at an intermediate portion thereof; and a controller configured to control the liquid jetting head and the pump to execute:

printing based on a print data input to the controller, recovering the plurality of nozzles by discharging the liquid from the plurality of nozzles to the receiver, and discharging the liquid, which is present in at least one of the receiver and the connection channel, to the waste-liquid storage;

wherein under a condition that there is no input of the print data to the controller before the discharging of the liquid to the waste-liquid storage, the controller controls the liquid jetting head to execute the discharging of the liquid to the waste-liquid storage continuously after the recovering of the plurality of nozzles, and wherein under a condition that there is an input of the print data to the controller before the discharging of the liquid to the waste-liquid storage, the controller controls the liquid jetting head to execute the printing after the recovering of the plurality of nozzles and then the controller controls the pump to execute at least a part of the discharging of the liquid to the waste-liquid storage.

According to the present teaching, in a maintenance processing including a nozzle recovery operation for recovering the plurality of nozzles and a discharge operation for discharging the liquid to the waste-liquid storage, in a case that there is an input of the print data before the discharge operation is executed in the maintenance processing, the print processing is executed during the execution of the maintenance processing. Then, at least a part of the discharge operation is executed after the print processing. Therefore, it is possible to shift from the maintenance processing to the print processing quickly. Note that, it is generally preferred that the discharge operation is executed continuously after the nozzle recovery operation is executed so as to prevent the liquid, discharged in the nozzle recovery operation, from remaining in respective parts or components. The discharge operation, however, is not a processing directly affecting the print quality, unlike the nozzle recovery operation. Accordingly, it is not necessarily indispensable to execute the entirety of the discharge operation before the print processing. The present teaching focuses on this point and executes a quick start of the print processing preferentially, while postponing at least a part or portion of the discharge operation of which priority is low.

BRIEF DESCRIPTION OF THE DRAWINGS

FIGS. 2A to 2D are each a top view depicting the schematic configuration of a pump, wherein FIG. 2A is a view depicting a suction-enable state, FIG. 2B is a view omitting a rotating plate in FIG. 2A, FIG. 2C is a view depicting an atmosphere-communication state, and FIG. 2D is a view omitting the rotating plate in FIG. 2C.

DESCRIPTION OF THE EMBODIMENTS

In the following, an embodiment of the present teaching will be explained, with reference to the drawings as appropriate.

<Overall Configuration of Printer>

Figure 1:
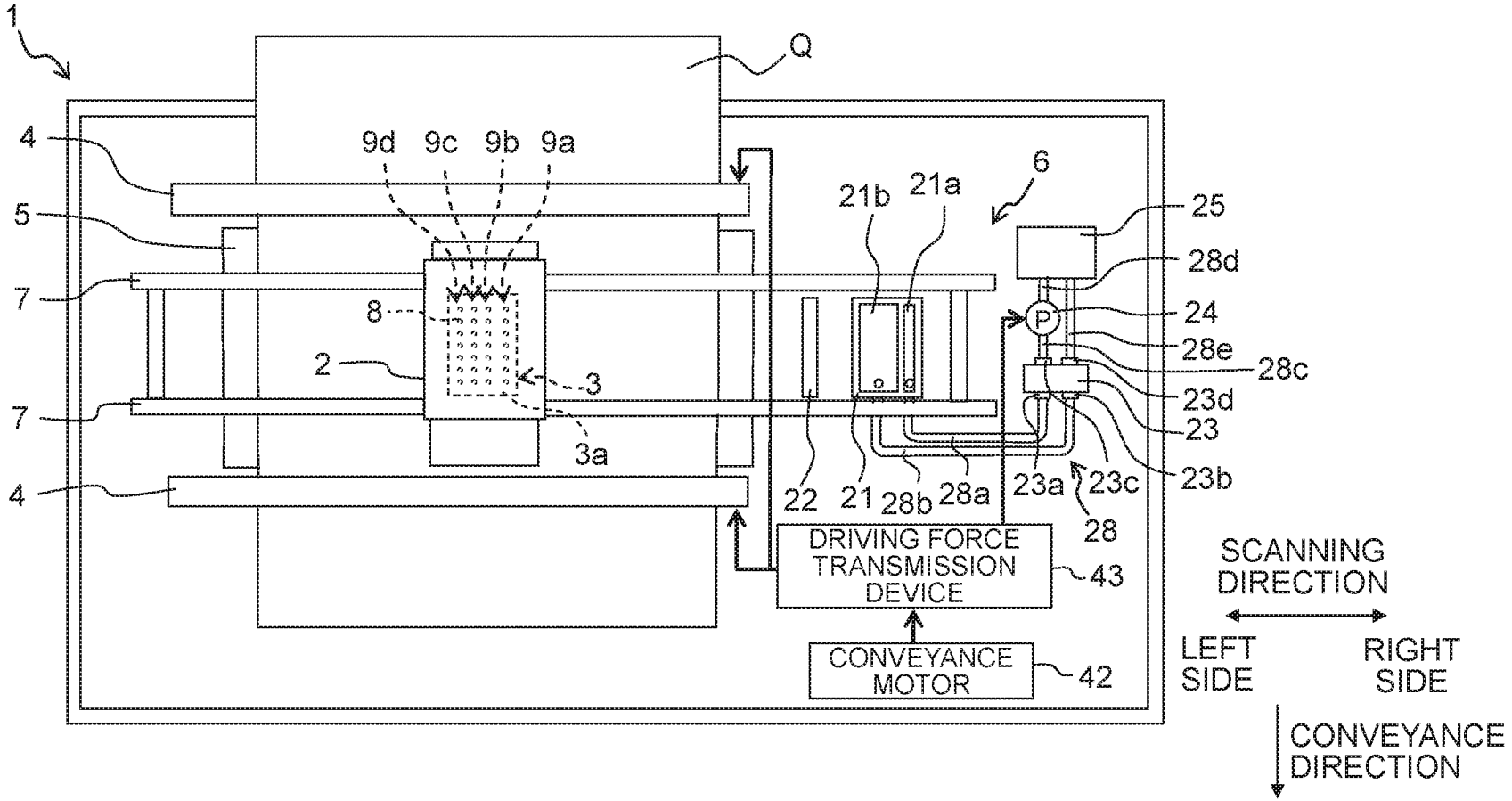
FIG. 1 is a view depicting the schematic configuration of a printer according to an embodiment of the present teaching.

As depicted in FIG. 1, a printer 1 according to an embodiment of the present teaching is provided with a carriage 2, an ink-jet head 3, a conveyance roller 4, a platen 5, a maintenance unit 6, etc.

The carriage 2 is configured to be movable in a scanning direction by a pair of guide rails 7 extending in the scanning direction. The carriage 2 is connected to a carriage motor 41 (see FIG. 3) via a non-illustrated belt, a non-illustrated pulley, etc. The carriage 2 reciprocates in the scanning direction by being driven by the carriage motor 41. Note that in the following, explanation will be given with the right and left sides in the scanning direction being defined as depicted in FIG. 1. Further, the direction perpendicular to the sheet surface of FIG. 1 corresponds to the up/down direction, and the front side and the far side of the sheet surface of FIG. 1 correspond respectively to the upper side and the lower side.

The ink-jet head 3 is mounted on the carriage 2. The lower surface of the ink-jet head 3 is a nozzle surface 3*a* formed with a plurality of nozzles 8 via which an ink is jetted or discharged. The plurality of nozzles 8 construct nozzle rows 9*a*, 9*b*, 9*c* and 9*d* along a conveyance direction orthogonal to the scanning direction; the nozzle rows 9*a*, 9*b*, 9*c* and 9*d* are arranged in this order from the right side to the left side in the scanning direction. A black ink is jetted from nozzles 8, among the plurality of nozzles 8, belonging to the nozzle row 9*a*. A yellow ink is jetted from nozzles 8, among the plurality of nozzles 8, belonging to the nozzle row 9*b*. A cyan ink is jetted from nozzles 8, among the plurality of nozzles 8, belonging to the nozzle row 9*c*. A magenta ink is jetted from nozzles 8, among the plurality of nozzles 8, belonging to the nozzle row 9*d*. In the following, the nozzles 8 of the nozzle row 9*a* is referred to as "black nozzles" and the nozzles 8 of the nozzle rows 9*b*, 9*c* and 9*d* are referred to as "color nozzles" as necessary.

The conveyance roller 4 is provided as two conveyance rollers 4 arranged respectively on the both sides in the conveyance direction of the carriage 2. The two conveyance rollers 4 are driven by a conveyance motor 42 (see FIG. 3) to thereby convey a recording paper (recording sheet or recording paper sheet) Q in the conveyance direction. The platen 5 is arranged between the two conveyance rollers 4 in the conveyance direction and supports the recording paper Q, from therebelow, which is being conveyed by the conveyance rollers 4. Then, the printer 1 execute a print processing on the recording paper Q by jetting the inks from the ink jet head 3 which is reciprocatingly moving together with the carriage 2 in the scanning direction while the printer 1 causes the conveyance rollers 4 to convey the recording paper Q in the conveyance direction.

In this situation, the conveyance motor 42 is configured to be switchable, by a driving force transmission device 43, between a state that the conveyance motor 42 is capable of transmitting driving force to the conveyance roller 4 and another state that the conveyance motor 42 is capable of transmitting the driving force to a pump 24. In this embodiment, in a case that the carriage 2 is moved in the scanning direction to a position at which the nozzle surface 3*a* is capable of facing a cap 21 (to be described later on), the transmitting force switching mechanism 43 is mechanically activated so as to switch the conveyance motor 42 to the state that the conveyance motor 42 is capable of transmitting the driving force to the pump 24. Note that, however, it is allowable that the operation of the driving force transmission device 43 is controlled, for example, by a controller 60 (see FIG. 3).

<Maintenance Unit>

The maintenance unit 6 is arranged on one side (the right side in this embodiment) of the platen 2 in the scanning direction. The maintenance unit 6 includes a cap 21, a wiper 22, a switching valve 23, the pump 24, a waste-liquid storing section 25, a connecting channel 28, etc.

Figure 3:
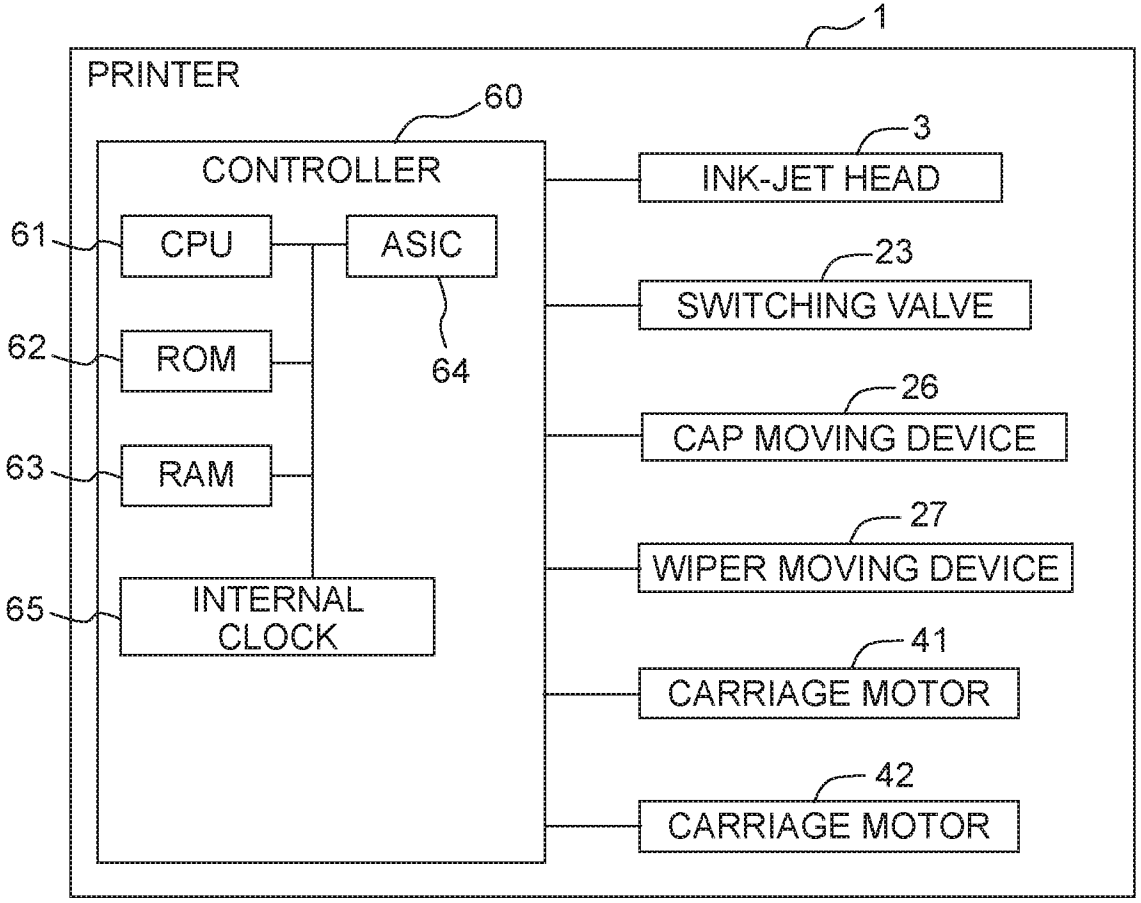
FIG. 3 is a block diagram showing the electrical configuration of the printer.

The cap 21 is arranged on the right side of the platen 5 in the scanning direction, and is capable of being raised and lowered (moving in the up/down direction) by a cap moving device 26 (see FIG. 3). The cap 21 is formed of a rubber material, etc., and has a recessed portion 21*a* for black ink and a recessed portion 21*b* for color inks which are open to the nozzle surface 3*a* and are arranged side by side in the scanning direction. The recessed portion 21*a* for black is capable of covering the black nozzles 8 of the nozzle row 9*a* whereas the recessed portion 21*b* for color is capable of covering the color nozzles 8 of the nozzle rows 9*b*, 9*c*, and 9*d*.

In a case that the cap 21 is moved upwardly by the cap moving device 26 in a state that the carriage 2 is moved in the scanning direction up to such a position at which the nozzle surface 3*a* faces the cap 21, the cap 21 makes contact with the nozzle surface 3*a*. In this situation, spaces defined respectively by the recessed portions 21*a* and 21*b* and the nozzle surface 3*a* are not communicated with the atmosphere, thereby allowing the cap 21 to have an atmosphere-cutoff state (such a state that the cap 21 is cut off or disconnected from the atmosphere). On the other hand, in a case that the cap 21 is moved from this state downwardly by the cap moving device 26, then cap 21 is separated from the nozzle surface 3*a* and allows the recessed portions 21*a* and 21*b* to communicate with the atmosphere, thereby allowing the cap 21 to have an atmosphere-communication state (such a state that the cap 21 is communicated with the atmosphere). In the following, a position at which the cap 21 makes contact with the nozzle surface 3*a* is referred to as a "contact position", and a position at which the cap 21 is separated from the nozzle surface 3*a* is referred to as a "separate position".

The wiper 22 is arranged between the platen 5 and the cap 21 in the scanning direction, and is movable upward and downward by a wiper moving device 27 (see FIG. 3). The wiper 22 is formed of a rubber material, etc. In a case that the carriage 2 is allowed to pass through a position at which the carriage 2 faces the wiper 22 in a state that the wiper 22 is moved upwardly by the wiper moving device 27 such that an upper end portion of the wiper 22 is positioned above the nozzle surface 3*a*, then the wiper 22 wipes off any ink adhered to the nozzle surface 3*a*. On the other hand, in a state that the wiper 22 is moved downwardly (lowered) by the wiper moving device 27 such that the upper end portion of the wiper 22 is positioned below the nozzle surface 3*a*, even if the carriage 2 is allowed to pass through the position at which the carriage 2 faces the wiper 22, the wiper 22 does not make contact with the nozzle surface 3*a*.

The switching valve 23 has a first cap communicating port 23*a*, a second cap communicating port 23*b*, a pump communicating port 23*c* and an atmosphere communicating port 23*d*, and is configured to switch the communication state among the respective ports 23*a* to 23*d*. Although any detailed explanation will be omitted, the switching valve 23 has, for example, a channel member formed with channels for allowing the communication among the respective ports 23*a* to 23*d*, and a housing formed with the ports 23*a* to 23*d* and accommodating the channel member to be movable therein. The switching valve 23 switches the communication state among the respective ports 23*a* to 23*d* by allowing the channel member to move within the housing.

The connecting channel 28 is a channel connecting the cap 21 to the waste-liquid storing section 25, and is specifically defined by tubes 28*a* to 28*e*. The first cap communicating port 23*a* is connected to the recessed portion 21*a* for black via the tube 28*a*. The second cap communicating port 23*b* is connected to the recessed portion 21*b* for color via the tube 28*b*. The pump communicating port 23*c* is connected to the tube pump 24 via the tube 28*c*, and the pump communicating port 23*c* is further connected to the waste-liquid storing section 25 via the tube 28*c*, the pump 24 and the tube 28*d*. The atmosphere communicating port 23*d* is connected to the waste-liquid storing section 25 via the tube 28*e*. Note that the waste-liquid storing section 25 stores the inks, etc., discharged by the respective kinds of the maintenance processing (to be described later on). The waste-liquid storing section 25 is, for example, a waste-liquid tank. The waste-liquid storing section 25 has a space for storing the inks, etc., which is communicated with the atmosphere. Note that, however, it is also allowable that a foam member as the waste-liquid storing section 25 is arranged, for example, on the bottom surface of the casing of the printer 1 and that liquid such as the inks is discharged onto the foam member.

The pump 24 is connected to the pump communicating port 23*c* of the switching valve 23 via the tube 28*c*, and is capable of sucking the inks from a portion, of the pump 24, communicating with the pump communicating port 23*c*. Further, the pump 24 is connected to the waste-liquid storing section 25 via the tube 28*d*, and is configured to be capable of discharging the sucked inks to the waste-liquid storing section 25.

As depicted in FIGS. 2A to 2D, the pump 24 is a tube pump, and has a casing 51, a rotating plate 52, a tube 53 and a roller 54.

The casing 51 is a member having a substantially cylindrical shape of which upper end portion is open. The rotating plate 52 is a plate-shaped member having a circular shape, and closes the opening in the upper end portion of the casing 51. A gear section 52*a* is provided on a central portion of the rotating plate 52. The gear section 52*a* is connected to the conveyance motor 42 via the driving force transmission device 43. In a case that the conveyance motor 24 is driven in a state that the conveyance motor 24 is capable of transmitting the driving force to the pump 24 by the driving force transmission device 43, the rotating plate 52 is rotated as a result. A through groove 52*b* is formed in the rotating plate 52. Although the through groove 52*b* extends in a circular arc shape, the center of the circular arc is shifted from the center of the rotating plate 52. With this, the through groove 52*b* is allowed to have such a shape that extends toward the inner side in the radial direction of the rotating plate 52 from an upstream side portion toward a downstream side portion of the through groove 52*b* in the clockwise direction in FIGS. 2A to 2D.

The tube 53 is accommodated in an internal space 51*a* of the casing 51. The tube 53 is arranged in a spiral shape to be cycled approximately 1.5 times along the circumference of an inner wall 51*b* of the casing 51. Further, both end portions of the tube 53 are connected to the tube 28*c* and the tube 28*d*, respectively. The roller 54 is a member having a circular cylindrical shape, and is accommodated in the internal space 51*a* of the casing 51. A projection 54*a*, projecting upwardly, is provided on a central portion of the roller 54. The projection 54*a* is inserted into the through groove 52*b* of the rotating plate 52.

Figure 2A:
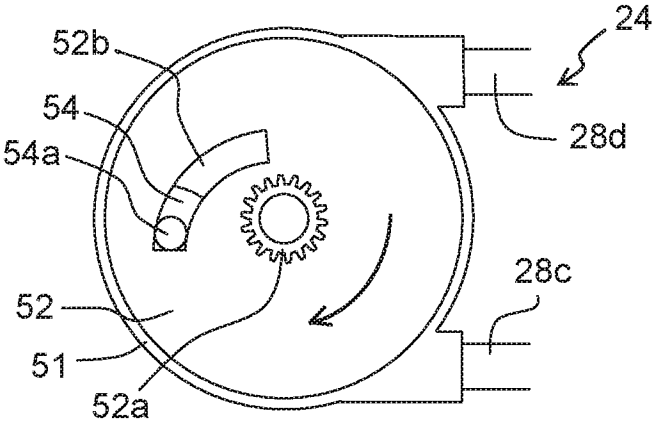
Figure 2B:
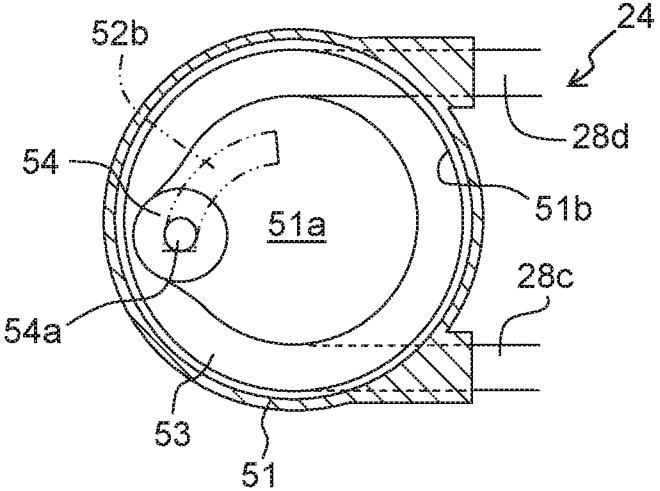

In a case that the rotating plate 52 is rotated in the clockwise direction of FIGS. 2A to 2D, the projection 54*a* is guided by the through groove 52*b* as depicted in FIGS. 2A and 2B, thereby moving the roller 54 to the outer side in the radial direction of the casing 54 and cause the roller 54 to crush or pushes the tube 53. This provides a suction-enabled state in which the communication between a portion, of the tube 53, located on the side of the tube 28*c* and a portion, of the tube 53, located on the side of the tube 28*d* is cut off. In a case that the rotating plate 52 in this state is rotated further in the clockwise direction, the roller 54 is rotated in the clockwise direction in a state that the roller 54 is crushing the tube 53, and thus the suction is executed.

Figure 2C:
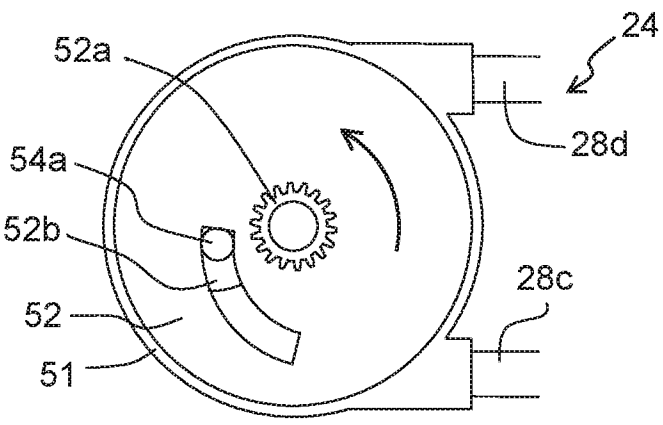
Figure 2D:
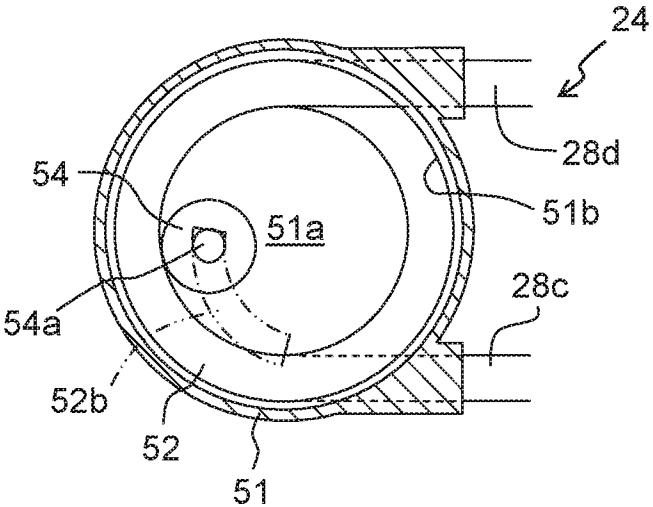

On the other hand, in a case that the rotating plate 52 is rotated in the counterclockwise direction of FIGS. 2A to 2D, the projection 54*a* is guided by the through groove 52*b* as depicted in FIGS. 2*c* and 2*d*, thereby causing the roller 54 to move to the inner side in the radial direction of the casing 51 and cause the roller 54 to separate from the tube 53. This allows the tubes 28*c* and 28*d* to communicate with each other via the tube 53, and allows the pump 24 to have the atmosphere-communication state.

<Electrical Configuration>

As depicted in FIG. 3, the controller 60 is provided with a CPU (Central Processing Unit) 61, a ROM (Read Only Memory) 62, a RAM (Random Access Memory) 63, ASIC (Application Specific Integrated Circuit) 64, an internal clock 65 measuring the time, and the like. These components or parts described above cooperate to control the operations of the ink-jet head 3, the switching valve 23, the cap moving device 26, the wiper moving device 27, the carriage motor 41, the conveyance motor 42, and the like.

The controller 60 is capable of obtaining a various kinds of time such as an elapsed time, elapsed since the last time the print processing has been completed, by utilizing output from the internal clock 65, and is capable of storing the obtained times in the ROM 62 and/or the RAM 63. These times are used as one of the materials for determining whether or not a various kinds of maintenance processing (to be described later on) are to be executed.

Note that although FIG. 3 depicts only one CPU 61, it is allowable that the controller 60 is provided with only one piece of the CPU 61 and that this single CPU 61 collectively performs the necessary processings. Alternatively, it is allowable that the controller 60 is provided with a plurality of pieces of the CPU 61 and that these CPUs 61 perform the necessary processings in a sharing manner. Further, note that although FIG. 3 depicts only one ASIC 64, it is allowable that the controller 60 is provided with only one piece of the ASIC 64 and the single ASIC 64 collectively performs the necessary processings. Alternatively, it is allowable that the controller 60 is provided with a plurality of pieces of the ASICS 64 and that these ASICs 64 execute the necessary processings in a shared manner.

<Kinds of Maintenance Processing>

In the printer 1 having the above-described configuration, a variety of kinds of maintenance processing can be executed in order to maintain the ink-jet head 3 in an appropriate state for printing. The maintenance processing executed in the printer 1 includes, for example, a full maintenance processing, a periodic maintenance processing which is executed periodically, a pre-print maintenance processing which is executed in a case that a print instruction is received, and the like. In the following, the explanation will be given about the full maintenance processing, the periodic maintenance processing and the pre-print maintenance processing.

<Full Maintenance Processing>

The full maintenance processing is executed in a case that a user issues a maintenance instruction via a non-illustrated operating section and that the maintenance instruction is received by the controller 60.

At first, the controller 60 controls the pump 24 to thereby execute a suction purge operation for sucking an inks from the plurality of nozzles 8 so as to discharge a thickened or viscous inks from the plurality of nozzles 8 (step S11). In the suction purge operation, the cap moving device 26 moves the cap 21 to be located at the contact position in a state that the nozzle surface 3*a* of the ink-jet head 3 is made to face the cap 21. In this situation, the conveyance motor 42 is in the state that the conveyance motor 42 is capable of transmitting the driving force to the pump 24, by the driving force transmission device 43 (hereinafter referred also as the "transmission-enable state" as appropriate).

Figure 5A:
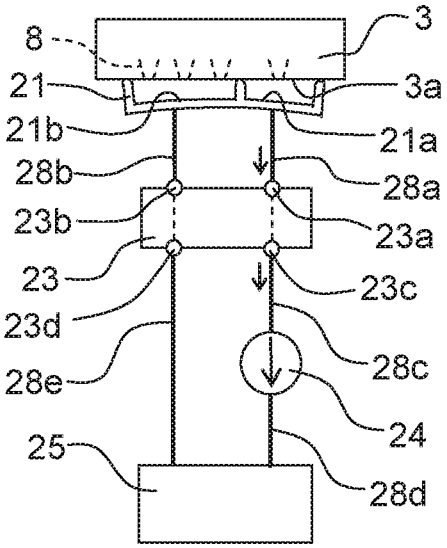
FIGS. 5A to 5D are each a schematic view depicting a state of a maintenance unit in one of respective operations.

The suction purge operation includes a BK suction purge operation of which object is the black nozzles 8 (also referred to as a "first suction purge operation") and a CL suction purge operation of which object is the color nozzles 8 (also referred to as a "second suction purge operation"). There is no particular order by which the BK and CL suction purge operations are executed. In the BK suction purge operation, the switching valve 23 is allowed to be a state that the first cap communicating port 23*a* and the pump communicating port 23*c* are communicated with each other and that the second cap communicating port 23*b* and the atmosphere communicating port 23*d* are communicated with each other, as depicted in FIG. 5A. By driving the pump 24 in this state, the black ink is sucked from the black nozzles 8 and is discharged to the waste-liquid storing section 25.

In this situation, since the pressure inside the recessed portion 21*a* for black is lowered, the cap 21 is deformed to project upwardly as a whole, as depicted in FIG. 5A. With this, the volumes of the recessed portions 21*a* and 21*b* are both reduced. Accordingly, if the recessed portions 21*b* for color are sealed, there is such a fear that the pressure inside the recessed portion 21*b* for color might be increased and consequently might destroy the meniscus of the ink inside the color nozzles 8. In view of this, the recessed portion 21*b* for color is allowed to communicate with the atmosphere during the BK suction purge operation as described above. With this, it is possible to suppress the increase in the pressure inside the recessed portion 21*b* for color and to suppress the destroying of the meniscus.

Figure 5B:
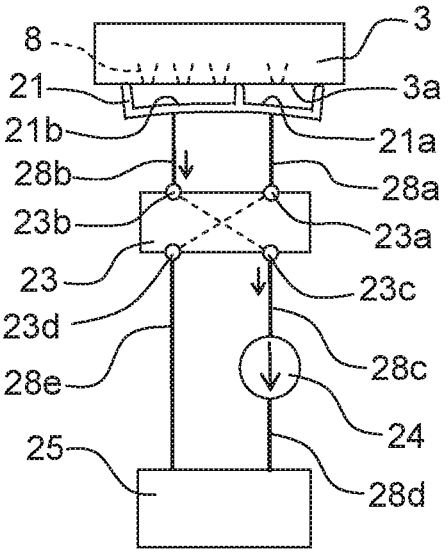

In the CL suction purge operation, the switching valve 23 is allowed to be a state that the second cap communicating port 23*b* and the pump communicating port 23*c* are communicated with each other and that the first cap communicating port 23*a* and the atmosphere communicating port 23*d* are communicated with each other, as depicted in FIG. 5B. By driving the pump 24 in this state, the color inks are sucked from the color nozzles 8 and are discharged to the waste-liquid storing section 25. Also during the CL suction purge operation, the recessed portion 21*a* for black is allowed to communicate with the atmosphere, in a similar manner as in the BK suction purge operation, it is possible to suppress the increase in the pressure inside the recessed portion 21*a* for black and to suppress the destroying of the meniscus.

Figure 5C:
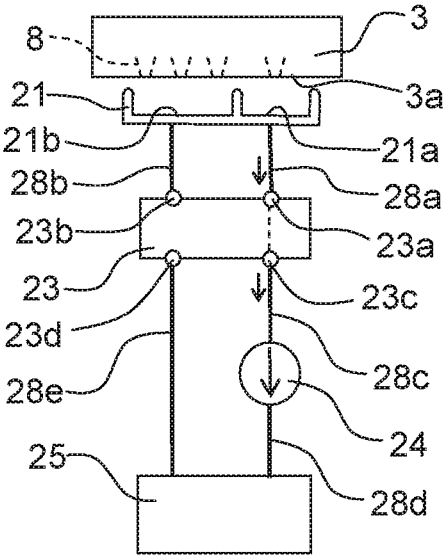
Figure 5D:
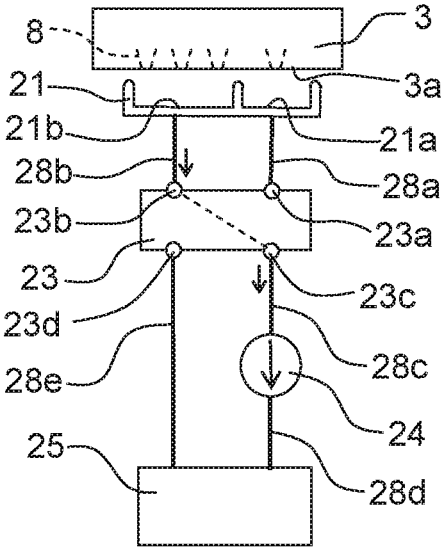

Next, in order to discharge the inks accumulated in the cap 21 by the suction purge processing, the controller 60 controls the pump 24 to thereby execute an idle suction operation for discharging the inks inside the cap 21 (step S12). In the idle suction operation, the cap moving device 26 moves the cap 21 to be located at the separate position so as to allow the cap 21 to have the atmosphere-communication state, as depicted in FIGS. 5C and 5D.

The idle suction operation includes a BK idle suction operation of which object is the recessed portion 21*a* for black and a CL idle suction operation of which object is the recessed portion 21*b* for color. There is no particular order by which the BK and CL idle suction operations are executed. In the BK idle suction operation, the switching valve 23 is allowed to be in a state that the first cap communicating port 23*a* and the pump communicating port 23*c* are communicated with each other, as depicted in FIG. 5C. By driving the pump 24 in this state, the black ink accumulated in the recessed portion 23*a* for black is sucked and discharged to the waste-liquid storing section 25. In the CL idle suction operation, the switching valve 23 is allowed to be in a state that the second cap communicating port 23*b* and the pump communicating port 23*c* are communicated with each other, as depicted in FIG. 5D. By driving the pump 24 in this state, the color inks accumulated in the recessed portion 23*b* for color are sucked and discharged to the waste-liquid storing section 25.

Next, the controller 60 controls the wiper moving device 27 and the carriage motor 41 to thereby execute a wiping operation so as to wipe off the inks adhered to the nozzle surface 3*a* (steps S13). In the wiping operation, the wiper 22 is moved by the wiper moving device 27 so as to provide the state that the upper end portion of the wiper 22 is positioned above the nozzle surface 3*a*. By allowing the carriage motor 41 to move the carriage 2 in the scanning direction in this state, the inks adhered to the nozzle surface 3*a* is wiped off by the wiper 22.

Figure 6A:
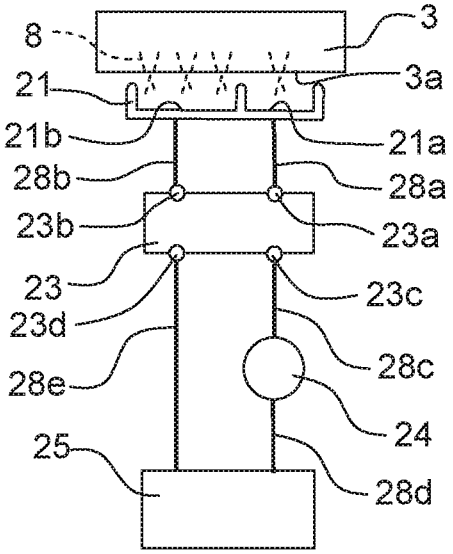
FIGS. 6A to 6D are each a schematic view depicting a state of a maintenance unit in one of respective operations.

Next, the controller 60 controls the ink-jet head 3 to thereby execute a flushing operation for jetting the inks (causing the inks to be jetted) from the plurality of nozzles 8 toward the cap 21 (step S14). The flushing operation is executed mainly for the purpose of dissolving a color mixture state which is generated due to the suction purge operation and in which a certain color ink jetted from certain nozzles 8 enters into other nozzles 8 of another color different from the certain color ink. In the flushing operation, the controller 60 controls the ink-jet head 3 to thereby cause the inks to be jetted from the plurality of nozzles 8 toward the cap 21 in the state that the controller 60 controls the cap moving device 26 to thereby move the cap 21 to be positioned at the separate position, as depicted in FIG. 6A.

In a conventional full maintenance processing, after the flushing operation in step S14 is completed, the controller 60 executes, continued from the flushing operation, an idle suction operation (step S16), a channel cleaning operation (step S17), an opening of pump-to-atmosphere operation (step S18) and a capping operation (step S19). However, in such a case that a print data is inputted during the execution of the full maintenance processing and that the print processing is executed after waiting the completion of the full maintenance processing, then a stand-by time (waiting time) until the print processing is started becomes long, which in turn causes inconvenience to the user. In view of this, in the case that the print data is inputted during the execution of the full maintenance processing, the printer 1 of the embodiment executes a part of the full maintenance processing after the print processing. This achieves the reduction in the standby time until the print processing is started.

Here, among the respective operations in the full maintenance processing, the suction purge operation (step S11) and the flushing operation (step S14) are each an operation for maintaining the state of the plurality of nozzles 8 to be satisfactory by jetting (discharging) the inks from the plurality of nozzles 8, and are important operations for maintaining the print quality (also referred to as a "nozzle recovery operation"). On the other hand, the idle suction operation (step S16) and the channel cleaning operation (step S17) are each an operation for sucking the ink present in the cap 21 and/or the connection channel 28 due to the nozzle recovery operation and for discharging the sucked inks to the waste-liquid storing section 25, with the pump 24 (also referred to as a "discharge operation"). Generally, the discharge operation is not an operation directly affecting the print quality, and can be considered as an operation with a low urgency. In view of this, in the case that the print data is inputted during the execution of the full maintenance processing, the printer 1 of the embodiment is configured to execute at least a part of the discharge operation of which urgency is low among the full maintenance processing, after the completion of the print processing, thereby reducing the standby time until the print processing is started, while maintaining the print quality.

After completing the flushing operation of step S14, the controller 60 determines whether or not there is an input of a print data (step S15). In a case that there is not any input of the print data, the controller 60 executes, continuously from the flushing operation of step S14, the idle suction operation (step S16), the channel cleaning operation (step S17), the opening of pump-to-atmosphere operation (step S18) and the capping operation (step S19). Explanation will be given firstly about these respective operations, and then regarding the flows of the processing in a case that there is an input of the print data after completing the flushing operation of step S14. Note that the timing for determining whether or not there is an input of the print data is not limited to as being immediately before the idle suction operation of step S16, and may be any appropriate timing until the idle suction operation of step S16 is executed.

The idle suction operation of step S16 is a processing for discharging the inks inside the cap 21 by the pump 24 so as to discharge the inks accumulated in the cap 21 by the flushing operation. Note that since the operation of the maintenance unit 6 in the idle suction operation in step S16 is similar to that in the operation of the maintenance unit 6 in the idle suction operation of step S12, any explanation for the idle suction operation in step S16 is omitted.

Figure 6B:
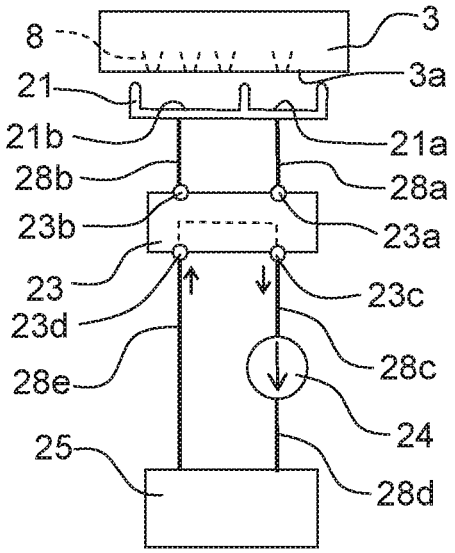
Figure 6C:
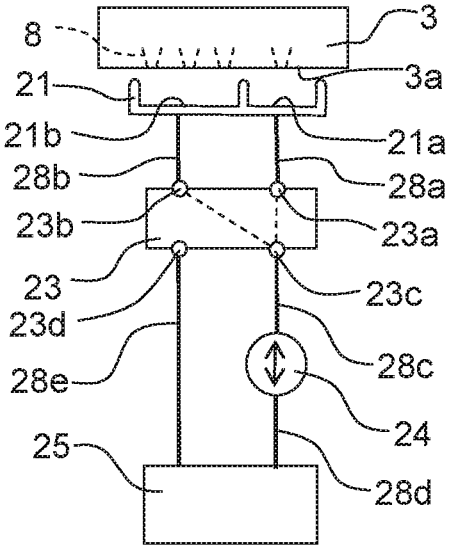

Next, the controller 60 executes the channel cleaning operation for discharging the inks present in the atmosphere communication port 23*d* of the switching valve 23 and the tube 28*e* (step S17). In the channel cleaning operation, the switching valve 23 is allowed to be in a state that the pump communicating port 23*c* and the atmosphere communicating port 23*d* are communicated with each other, as depicted in FIG. 6B. By driving the pump 24 in this state, the inks inside the atmosphere communication port 23*d* and the tube 28*e* are sucked and are discharged to the waste-liquid storing section 25. By executing the channel cleaning operation, it is possible to prevent any inks, flowing into the atmosphere communicating port 23*d* and the tube 28*e* which do not originally function as the channel for the inks, from being left as they are and solidified, and to prevent the atmosphere communicating port 23*d* and the tube 28*e* from being clogged by such a solidified inks.

Next, the controller 60 executes the opening of pump-to-atmosphere operation (step S18). The purpose of the opening of pump-to-atmosphere operation will be described later on. In the opening of pump-to-atmosphere operation, the rotating plate 52 of the pump 24 is rotated approximately one cycle in the counterclockwise direction of FIGS. 2A to 2D, thereby allowing the pump 24 to be in the atmosphere communication state. Further, in the opening of pump-to-atmosphere operation, the switching valve 23 is allowed to be in a state that the cap communicating ports 23*a* and 23*b* are communicated with the pump communicating port 23*c* in a state that the cap 21 is positioned at the separate position. Note that in FIGS. 6A to 6D, a double-sided arrow which is added to the pump 24 and of which arrows are oriented in the up and down directions respectively indicates that the pump 24 is in the atmosphere-communication state.

Figure 6D:
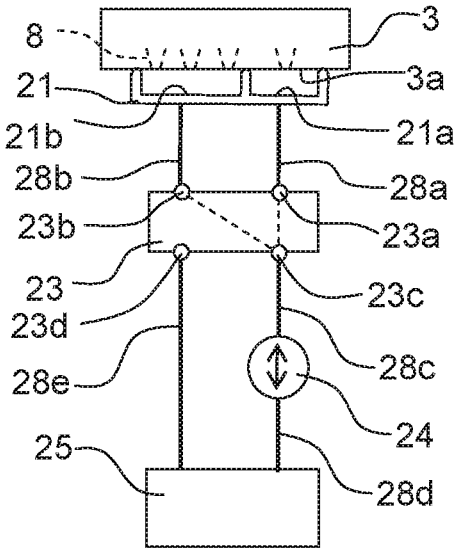

Finally, the controller 60 executes the capping operation so as to suppress any drying of the inks inside the nozzles 8 (step S19). In the capping operation, as depicted in FIG. 6D, the controller 60 controls the cap moving device 26 so as to position the cap 21 at the contact position, thereby causing the cap 21 to make tight contact with the nozzle surface 3*a*. Note that in the above-described channel cleaning operation and/or the opening of pump-to-atmosphere operation, the cap 21 may be moved to the contact position. In such a case, it is also possible to omit the capping operation.

Here, the purpose of the opening of pump-to-atmosphere operation will be explained. In the capping operation, in a case that the cap 21 is positioned at the contact position and is in the atmosphere-cutoff state and that the pressures inside the recessed portions 21*a* and 21*b* are changed due to any change in the temperature, etc., there is such a fear that the meniscus inside the nozzles 8 might be destroyed. In view of this, in the opening of pump-to-atmosphere state as described above, the cap communicating ports 23*a* and 23*b* are made to communicate with the pump communicating port 23*c* and the pump 24 is allowed to have the atmosphere-communication state. With this, it is possible to communicate the recessed portions 21*a* and 21*b* with the atmosphere even when the cap 21 is positioned at the contact position, thereby making it possible to suppress any deformation of the cap 21.

Note that in order to communicate the recessed portions 21*a* and 21*b* with the atmosphere, it is also conceivable to communicate the cap communicating ports 23*a* and 23*b* with the atmosphere communicating port 23*d*. In such a case, however, provided that any ink flowing into the switching valve 23 is left as it is and solidified and firmly fixed in the switching valve 23, it is not possible to dissolve the solidification and fixing of the ink in the switching valve 23. On the other hand, in the above case of communicating the cap communicating ports 23*a* and 23*b* with the pump communicating port 23*c*, even if any solidification and fixing of the ink occurs in the switching valve 23, the inks are sucked from the plurality of nozzles 8 when the pump 24 is driven, and the sucked inks flow into the switching valve 23. With this, the solidified ink in the switching valve 23 is dissolved by the moisture of the newly inflowed ink into the switching valve 23, thereby making it possible to dissolve the solidification and fixing of the ink in the switching valve 23.

Returning to step S15, an explanation will be given about the flow of processing in a case that there is an input of the print data. In a case that the print data is inputted, a part the idle suction operation (step S16), the channel cleaning operation (step S17), the opening of pump-to-atmosphere operation (step S18), the capping operation (step S19) are executed after the print processing (step S21). More specifically, the idle suction operation of step S16 is executed in divided manner as a first idle suction operation (step S20) to be executed before the print processing and a second idle suction operation (step S22) to be executed after the print processing. Namely, a time obtained by adding the operating time (action time) of the pump 24 in the first idle suction operation and the operation time of the pump 24 in the second idle suction operation is substantially same as the operation time of the pump 24 in the idle suction operation in step S16. Note that since the operations of the maintenance unit 6 in the first and second idle suction operations are similar to the operations of the maintenance unit 6 in the idle suction operations in steps S12 and S16, any further explanation for the first and second idle suction operations will be omitted here.

Here, it is needless to say that the case of executing the entirety of the idle suction operation in step S16 after the print processing makes it possible to shift to the print processing more quickly than the case of executing the idle suction operation in step S16 in divided manner as the first idle suction operation to be executed before the print processing and the second idle suction operation to be executed after the print processing. In the full maintenance processing in the embodiment, however, the idle suction operation is executed also before the print processing for the following reason.

Figure 4:
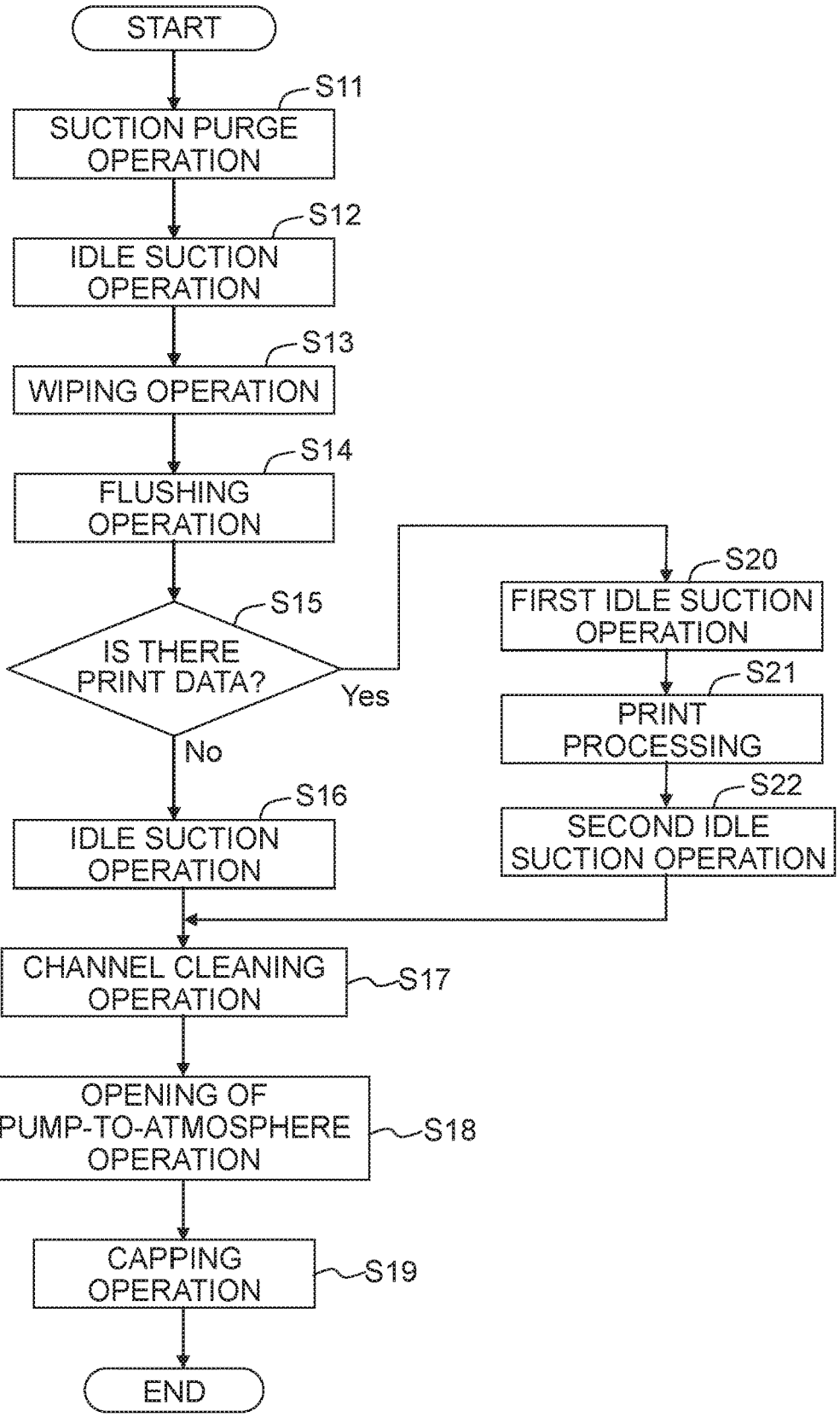
FIG. 4 is a flowchart depicting a full maintenance processing.

As appreciated from the flow chart of FIG. 4, the flushing operation of step S14 is a processing executed after the suction purge operation has been executed (also referred to as a "post-purge flushing operation"). When the suction purge operation is executed, the color mixture state of the inks is generated in the plurality of nozzles 8, and thus it is necessary that the inks in the color mixture state are discharged from the plurality of nozzles 8 in an ensured manner in the post-purge flushing operation to be executed after the suction purge operation. For this reason, the jetting amount of the inks in the post-purge flushing operation becomes great, which in turn allows a large amount of the inks to be accumulated in the inside of the cap 21. Provided that the idle suction operation is not executed at all before the print processing, then there is such a fear that the inks might spill or leak from the cap 21 during the print processing and might contaminate or dirty the printer 1. In particular, this problem will be prominent in such a case that any paper jam of the recording paper Q is caused during the print processing and a user removed the jammed recording paper Q, which in turn cause the printer 1 to vibrate (to be shaken) considerably. In view of this situation, the full maintenance processing of the embodiment executes the first idle suction operation before the print processing to thereby discharge only a small amount of the inks accumulated in the cap 21. By doing so, it is possible to suppress any spill of the ink from the cap 21 during the print processing and to shift to the print processing more quickly than the conventional technique or apparatus. Note that, however, in a case that the ink jetting amount of the ink in the post-purge flushing operation is not much, it is also allowable to execute the entirety of the idle suction operation after the print processing has been completed. Note that, generally speaking, regarding an ink jetting amount required in the post-purge flushing operation, the ink jetting amount required in a case that the suction purge is executed rather strongly (strong purge) in the suction purge operation is small, as compared with a case that the suction purge is executed rather weakly (weak purge) in the suction purge operation. In a case that the strong purge is executed, a large amount of the ink is accumulated in the inside of the cap 21. When the cap 21 is separated from the nozzle surface, the large amount of the ink accumulated in the cap 21 smoothly moves to the side of the cap 21, and thus hardly remains on the nozzle surface. On the other hand, in a case that the weak purge is executed, when the cap 21 is separated from the nozzle surface, it is rather difficult for the ink to smoothly move to the side of the cap 21, and thus the ink easily remains on the nozzle surface.

<Periodic Maintenance Processing>

The periodic maintenance processing is a maintenance processing which is executed basically at intervals of a predetermined time Ta1. In the following, an explanation will be given firstly about the determination processing as to whether or not the periodic maintenance processing is to be executed, then about the specific content of the periodic maintenance processing.

At first, the controller 60 utilizes output from the internal clock 65 and deduces, from the current time, the time of executing the periodic maintenance processing the previous time (last time), and thus obtains an elapsed time Ta elapsed since the periodic maintenance processing executed the previous time; and the controller 60 determines whether or not the elapsed time Ta exceeds the predetermined time Ta1 (step S31). In a case that the elapsed time Ta exceeds the predetermined time Ta1, the controller 60 then determines whether or not there is any input of the print data (step S32). In a case that there is not any input of the print data (step S32: NO), the controller 60 executes the periodic maintenance processing as it is (step S33). On the other hand, in a case that there is an input of the print data (step S32: YES), the controller 60 executes the print processing (step S34) first, and then executes the periodic maintenance processing after executing the print processing, so as to execute the print processing preferentially to the periodic maintenance processing.

Figure 7:
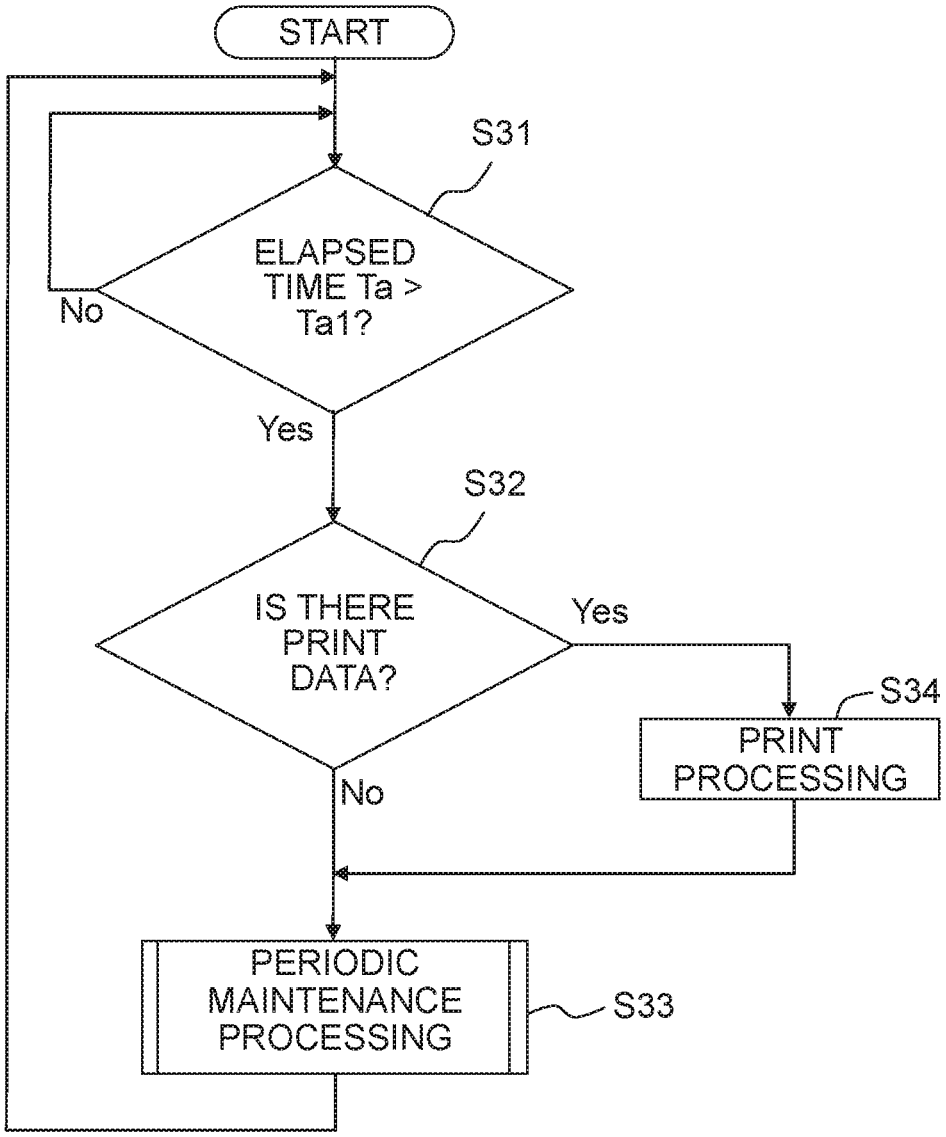
FIG. 7 is a flowchart of a determination processing for determining whether or not a periodic maintenance processing is to be executed.

Note that since the operations of the maintenance unit 6 in the respective steps of the periodic maintenance processing are similar to the respective operations explained regarding the full maintenance processing, any further explanation for the periodic maintenance processing will be omitted here. In the periodic maintenance processing, at first, the controller 60 controls the ink-jet head 3 to execute the flushing operation (step S41; also referred to a "periodic flushing operation"). Next, the controller 60 determines whether or not there is any input of the print data (step S42). Note that the presence/absence of the print data is determined also in step S32 of FIG. 7; in such a case that the print data is inputted in step S32, the periodic maintenance processing is not executed in the first place. Namely, a situation that the determination is made that print data is inputted in step S42 is actually a case that the print data is inputted after an execution instruction of the periodic maintenance processing is issued and before the idle suction operation of step S43 is executed.

In a case that there is not any input of the print data in step S42 (step S42: NO), the controller 60 executes the idle suction processing (step S43) and the capping operation (step S44) to thereby complete the periodic maintenance processing. On the other hand, in a case that there is an input of the print data in step S42 (step S42: YES), the controller 60 executes the print processing (step S45) first, and then executes the idle suction processing (step S43) and the capping operation (step S44) to thereby complete the periodic maintenance processing.

Here, the periodic flushing operation in step S41 is a processing corresponding to the "nozzle recovery processing" of the present teaching, and the idle suction operation in step S43 is a processing corresponding to the "discharge operation" of the present teaching. In a case that the print data is inputted during the execution of the periodic maintenance processing, the nozzle recovery operation which is important in view of maintaining the print quality is executed before the print processing. However, at least a part of the discharge operation of which urgency is low is executed after the completion of the print processing. With this, it is possible to reduce the standby time until the print processing is started, while maintaining the print quality.

Note that the ink jetting amount of the inks in the periodic flushing operation in step S41 is considerably small as compared, for example, with the above-described post-purge flushing operation (step S14 of FIG. 4), and there is hardly such a fear that the inks might spill from the cap 21. Accordingly, in the periodic maintenance processing of the present embodiment, the entirety of the idle suction operation is executed after the print processing. Note that, however, in such a case that the ink jetting amount of the inks in the periodic flushing operation is large, a part of the idle suction operation may be executed before the print processing.

<Pre-Print Maintenance Processing>

The pre-print maintenance processing is a maintenance processing which is executed basically in a case that there is an input of the print data (there is an input of a print instruction). In the following, an explanation will be given firstly about the determination processing as to whether or not the pre-print maintenance processing is to be executed, then about the specific content of the pre-print maintenance processing.

At first, the controller 60 utilizes output from the internal clock 65 and deduces, from the current time, the time of executing the print processing the previous time (last time), and thus obtains an elapsed time Tb elapsed since the print processing executed the previous time; and the controller 60 determines whether or not the elapsed time Tb exceeds a predetermined time Tb1 (step S51). Further, in a case that the elapsed time Tb exceeds the predetermined time Tb1 (step S51: YES), the controller 60 then stands by until the print data is inputted in a state that a flag, indicating that the elapsed time Tb exceeds the predetermined time Tb1, is set (step S52). Then, in a case that there is an input of the print data in a state that the flag is set (step S53: YES), the pre-print maintenance processing is executed (step S54). Note that the reason for making the setting of the flag also be the execution condition for the pre-print maintenance processing is to avoid such a situation that there are continuous inputs of the print data and the print processing therefor is continuously executed, and that the pre-print maintenance processing is executed every time before each of the continuously executed print processing is executed.

Since the operations of the maintenance unit 6 in the respective processings in the pre-print maintenance processing are similar to the respective operations explained regarding the full maintenance processing, any further explanation for the pre-print maintenance processing will be omitted here. In the pre-print maintenance processing, whether or not there is input of the print data is the prerequisite for executing the pre-print maintenance processing. Therefore, the determination as to whether or not there is input of the print data as indicated, for example, in step S15 of FIG. 4 is omitted. Firstly, the controller 60 determines whether or not a non-active time Tc of the internal clock 65 before execution of the pre-print maintenance operation, during which the internal clock 65 is not activated due to, for example, battery exhaustion is not more than a predetermined time Tc1 (which may be 0 (zero)) (step S61). Here, in a case that the non-active time Tc of the internal clock 65 is not more than the predetermined time Tc1, and that it is considered that the periodic flushing operation has been executed at intervals of the predetermined time Ta1 until then, there is a low possibility that the increase in the viscosity of the inks inside the nozzles 8 is progressed. On the other hand, in a case that the internal clock 65 is not activated due to, for example, battery exhaustion, etc., and that the non-active time Tc of the internal clock 65 is more than (longer than) the predetermined time Tc1, it is considered that until then the periodic flushing operation has not been executed at intervals of the predetermined time Ta1, and there is a high possibility that the increase in the viscosity of the inks inside the nozzles 8 is progressed. In view of this, the pre-print maintenance processing of the embodiment makes the processings which are to be executed, after the determination as to whether or not the non-active time Tc is longer than the predetermined time Tc1 is made, to be different depending on whether or not the non-active time Tc of the internal clock 65 is not more than the predetermined time Tc1.

The non-active time Tc of the internal clock 65 is obtained by the controller 60 in the following manner. Namely, for example, in a case that the electrical supply to the printer 1 is cut off and that the battery of the internal clock 65 is exhausted, the controller 60 stores the time immediately before the battery exhaustion in the non-volatile ROM 62. Afterwards, when the electrical supply to the printer 1 is resumed, the controller 60 obtains the time (current time) from a computer, etc., to which the printer 1 is connected, and obtains the non-active time Tc from the difference between the current time and the time immediately before the battery exhaustion stored in the ROM 62. Alternatively, it is allowable that the controller 60 sets a flag corresponding to the battery exhaustion immediately before the battery exhaustion, and determines that the non-active time Tc is greater than the predetermined time Tc1 based on the fact that the flag is set.

In a case that the non-active time Tc is not more than the predetermined time Tc1, the controller 60 controls the ink-jet head 3 to thereby execute a normal flushing operation for jetting the inks from the plurality of nozzles 8 in a predetermined jetting amount (step S62). Next, the controller 60 executes the print processing (step S52), the idle suction operation (step S64) and the capping operation (step S65), and thus completes the pre-print maintenance processing.

On the other hand, in a case that the non-active time Tc is longer than the predetermined time Tc1, the controller 60 controls the ink-jet head 3 to thereby execute an extended flushing operation for jetting the inks from the plurality of nozzles 8 in a jetting amount greater than the predetermined jetting amount (step S66). By doing so, it is possible to discharge the inks, regarding which there is a high possibility that the increase in the viscosity thereof is progressed, from the plurality of nozzles 8 in an ensured manner. Next, the controller 60 executes the first idle suction operation (step S67), the print processing (step S68), the second idle suction operation (step S69) and the capping operation (step S65), and thus completes the pre-print maintenance processing.

Here, in the extended flushing operation, a larger amount of the inks than that in the normal flushing operation is allowed to remain in the cap 21. Provided that the idle suction operation is not executed at all before the print processing, there is such a fear that the inks might spill or leak from the cap 21 during the print processing and might contaminate or dirty the printer 1. In view of this, in the present embodiment, in a case that the extended flushing operation is executed, the first idle suction operation is executed before the print processing and the second idle suction operation is executed after the print processing as the idle suction operation. By discharging only a small amount of the inks accumulated in the cap 21 by the first idle suction operation executed before the print processing, it is possible to suppress any spill of the ink from the cap 21 during the print processing and to shift to the print processing more quickly than the conventional technique or apparatus. On the other hand, in the normal flushing operation, the amount of the ink accumulated in the cap 21 is not much, and thus there is a low probability that the ink spills from the cap 21. Accordingly, the entirety of the idle suction operation is executed after the print processing. Note that the normal flushing operation in step S62 and the extended flushing operation in step S66 correspond to the "pre-print flushing operation" of the present teaching.

Figure 8:
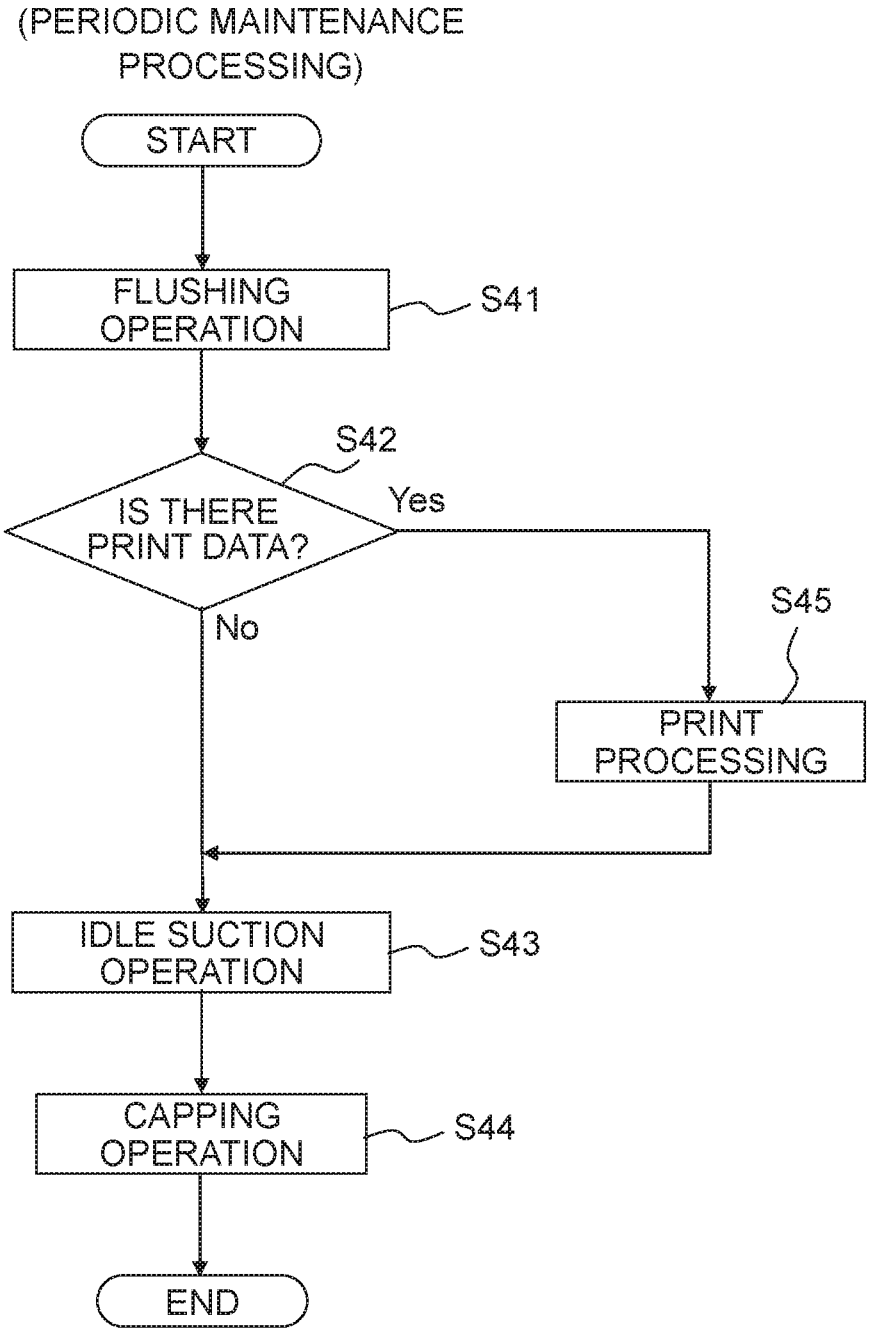
FIG. 8 is a flowchart depicting the periodic maintenance processing.
Figure 9:
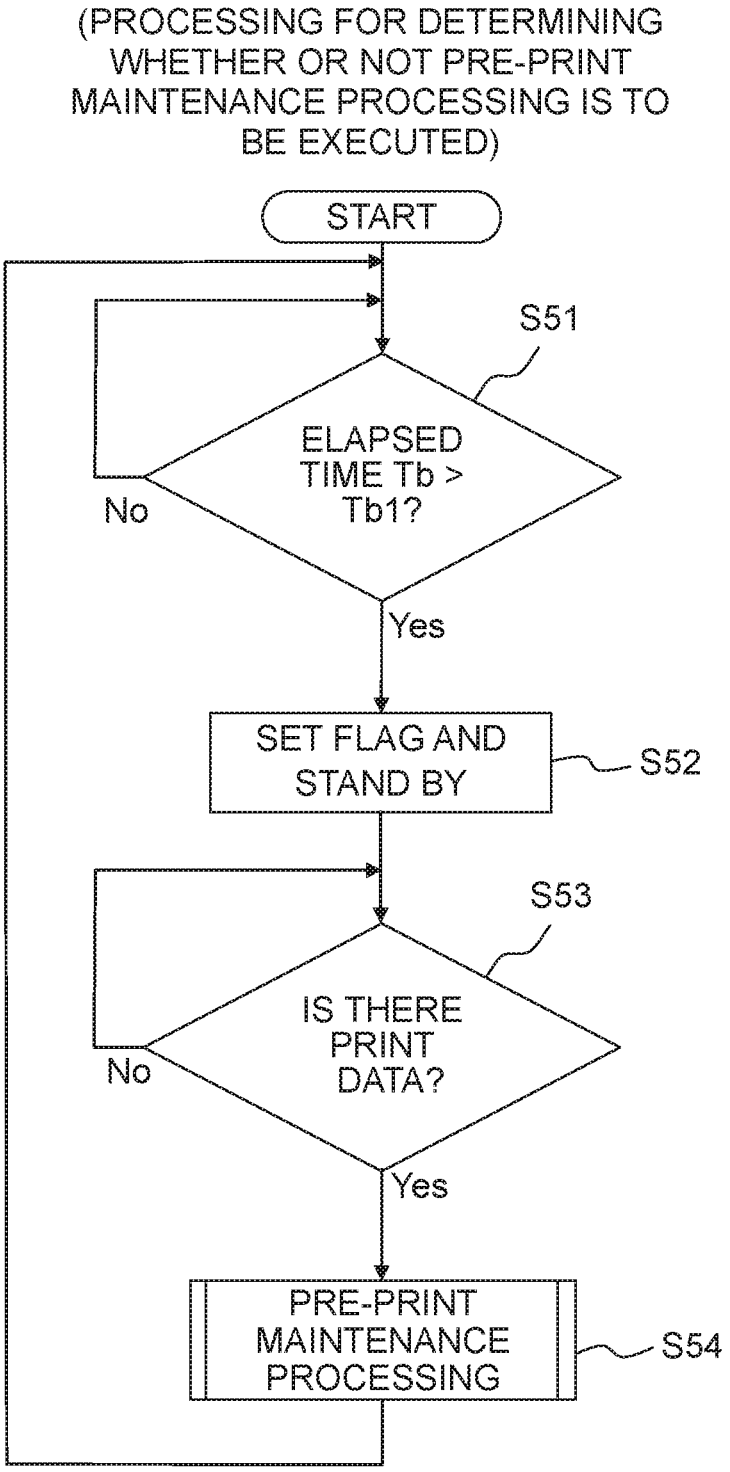
FIG. 9 is a flowchart a determination processing for determining whether or not a pre-print maintenance processing is to be executed.
Figure 10:
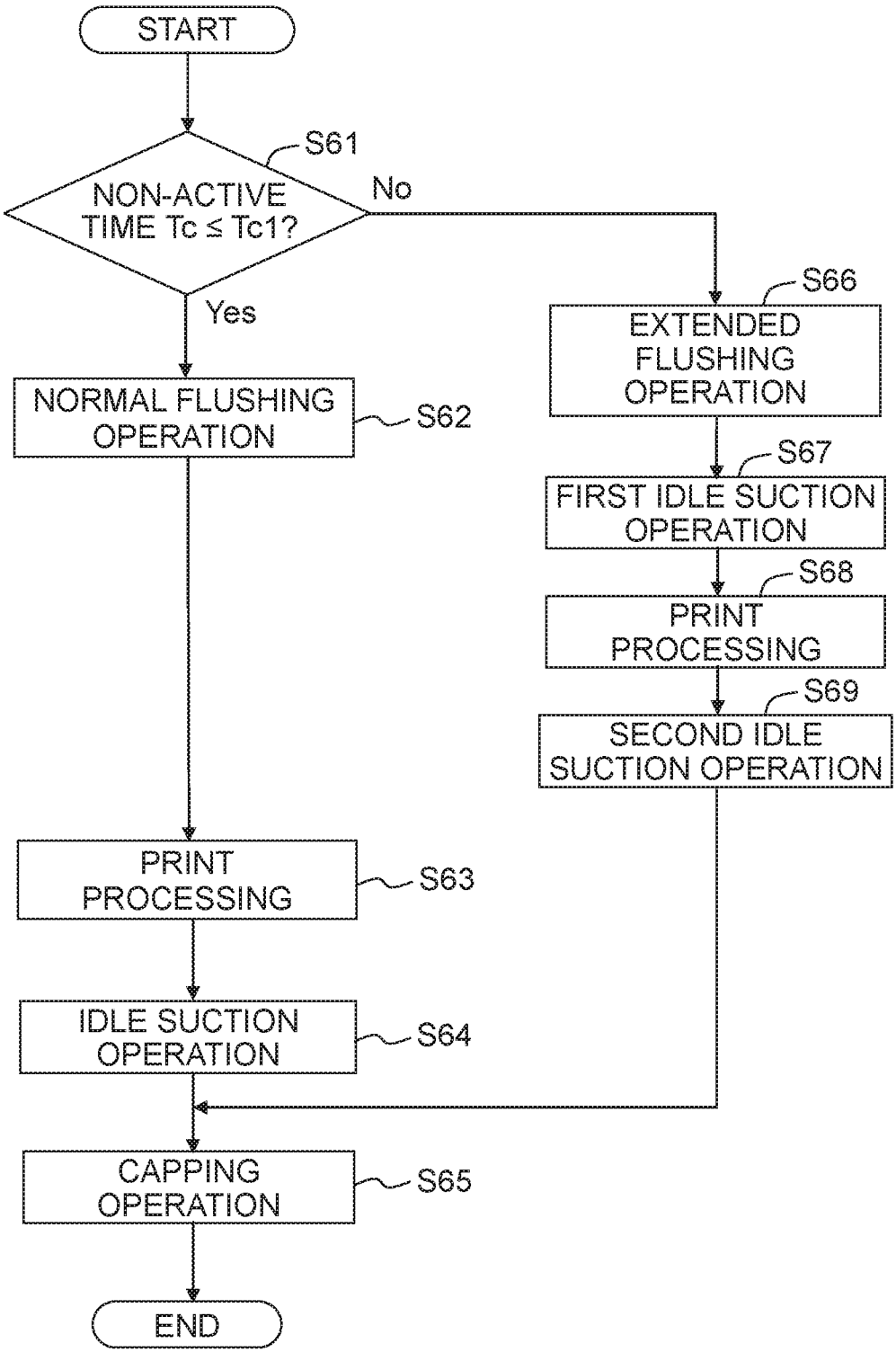
FIG. 10 is a flowchart depicting the pre-print maintenance processing.

As described above, the printer 1 of the embodiment is capable of executing, as the flushing operation, the post-purge flushing operation (step S14 of FIG. 4), the periodic flushing operation (step S41 of FIG. 8), the normal flushing operation (a kind of the pre-print flushing operation; step S62 of FIG. 10), and the extended flushing operation (a kind of the pre-print flushing operation; step S66 of FIG. 10) of which ink jetting amounts are different from one another. The magnitude correlation among the ink jetting amounts in the respective flushing operations is, for example, made to be as follows:

the post-purge flushing operation>the extended flushing operation>the periodic flushing operation>the normal flushing operation.

Further, in a case that the post-purge flushing operation and the extended flushing operation of which jetting amounts are relatively large are executed, a part of the idle suction operation to be executed thereafter is executed before the print processing. On the other hand, in a case that the periodic flushing operation and the normal flushing operation of which jetting amounts are relatively small are executed, the entirety of the idle suction operation to be executed thereafter is postponed to be executed after the print processing. Note that, however, depending on the ink jetting amount in the flushing operation, it is allowable to make an appropriately change between: executing only a part of the idle suction operation, which is to be executed after the flushing operation, before the print processing; and executing the entirety of the idle suction operation after the print processing.

In the embodiment as described above, the printer 1 corresponds to the "printer" of the present teaching. The ink corresponds to the "liquid" of the present teaching. The ink-jet head 3 corresponds to the "liquid jetting head" of the present teaching. Nozzles 8 in any one (certain) nozzle row among the nozzle rows 9*b*, 9*c* and 9*d* correspond to the "first nozzles" of the present teaching, and nozzles 8 in any other nozzle row in the remaining two nozzle rows and different from the certain nozzle row among the nozzle rows 9*b*, 9*c* and 9*d* correspond to the "second nozzle" of the present teaching. The cap 21 corresponds to the "receiving section" of the present teaching. The recessed portion 21*a* for black corresponds to the "first recessed portion" of the present teaching. The recessed portion 21*b* for color corresponds to the "second recessed portion" of the present teaching. Further, the tubes 28*a* to 28*e* constructs the "connecting channel" of the present teaching; among the tubes 28*a* to 28*e*, the tube 28*a* corresponds to the "first channel" of the present teaching, the tube 28*b* corresponds to the "second channel" of the present teaching, the tubes 28*c* and 28*d* correspond to the "third channel" of the present teaching, and the tube 28*e* corresponds to the "fourth channel" of the present teaching. Furthermore, the cap moving device 26 functions as the "cap switching device" of the present teaching.

According to the printer 1 of the present embodiment, in a case that there is input of the print data before the discharge operation (idle suction operation) is executed in the maintenance processing, the print processing is executed during (in the middle of) the execution of the maintenance processing, and at least a part of the discharge operation is executed after the print processing. Therefore, it is possible to shift from the maintenance processing to the print processing quickly. Note that, it is generally preferred that the discharge operation is executed continuously after the nozzle recovery operation (flushing operation) is executed so as to prevent the ink, discharged in the nozzle recovery operation (flushing operation), from remaining in the respective parts and/or components of the printer 1. The discharge operation, however, is not a processing directly affecting the print quality, unlike the nozzle recovery operation. Accordingly, it is not necessarily indispensable to execute the entirety of the discharge operation before the print processing. The printer 1 of the present embodiment focuses on this point and executes a quick start of the print processing preferentially, while postponing at least a part or portion of the discharge operation of which priority is low.

Further, in the embodiment, in a case that there is the input of the print data before the discharge operation is executed in the maintenance processing (for example, the periodic maintenance processing), the controller 60 is configured to execute entirety of the discharge operation after the print processing. According to such a configuration, by executing the entirety of the discharge operation after the print processing, it is possible to omit the discharge operation to be executed before the print processing, thereby making it possible to shift to the print processing more quickly.

Furthermore, in the embodiment, in a case that there is the input of the print data before the discharge operation is executed in the maintenance processing (for example, the full maintenance operation), the controller 60 is configured to execute a part of the discharge operation before the print processing and to execute a reminder of the discharge operation after the print processing. According to such a configuration, in a case that it is inconvenient to execute the entirety of the discharge operation after the print processing, it is possible to avoid such an inconvenience by executing a part of the discharge operation before the print processing, in the above-described manner.

Moreover, in the embodiment, the printer 1 is provided with the cap 21 which has, as the receiving section, the recessed portions 21*a* and 21*b* capable of facing the plurality of nozzles 8, the cap 21 being capable of making contact with the nozzle surface 3*a* so as to cover the plurality of nozzles 8. Further, the printer 1 is provided with the cap switching device (cap moving device 26) configured to switch the state of the cap 21 between the atmosphere shut-off state in which the spaces defined by the recessed portions 21*a* and 26*b* and the nozzle surface 3*a* in a state that the cap 21 makes contact with the nozzle surface 3*a* are sealed, without communicating with the outside of the cap, and the atmosphere-communication state in which the recessed portions 21*a* and 21*b* communicate with the outside. The controller 60 executes, as the discharge operation, the idle suction operation for discharging the inks inside the recessed portions 21*a* and 21*b* to the waste-liquid storing section 25 by controlling the cap moving device 26 and the pump 24 such that the pump 24 is activated in a state that the state of the cap 21 is switched to the atmosphere-communication state. In a case that there is the input of the print data before executing the idle suction operation, the controller 60 executes the print processing after the nozzle recovery operation, and executes at least a part of the idle suction operation after the print processing. According to such a configuration, by executing at least a part of the idle suction operation after the print processing, it is possible to shorten or omit the idle suction operation which is to be executed before the print processing and to quickly shift to the print processing.

Further, in the embodiment, the controller 60 executes, as the nozzle recovery operation, the flushing operation by controlling the liquid jetting head 3 to cause the inks to be jetted from the plurality of nozzles 8 toward the recessed portions 21*a* and 21*b*. According to such a configuration, in the idle suction operation for sucking the inks accumulated or stored in the inside of the recessed portions 21*a* and 21*b* by the flushing operation, a part of the idle suction operation which is to be executed before the print processing can be shortened or omitted, thereby making it possible to quickly shift to the print processing.

Furthermore, in the embodiment, for example, in the pre-print maintenance processing, under a condition that the predetermined condition (the non-active time Tc of the internal clock 65 is longer than the predetermined time Tc1) is satisfied, the controller 60 is capable of controlling the ink-jet head 3 so as to execute the flushing operation with a ink jetting amount of the ink which is greater than that under a condition that the predetermined condition is not satisfied. Under a condition that there is the input of the print data to the controller before executing the idle suction operation and that the predetermined condition is satisfied, the controller 60 executes a part of the idle suction operation before the print processing and executes a reminder of the idle suction operation after the print processing. On the other hand, under a condition that there is the input of the print data to the controller before executing the idle suction operation and that the predetermined condition is not satisfied, the controller 60 executes the entirety of the idle suction operation after the print processing. According to such a configuration, under the condition that the predetermined condition is satisfied, namely under the condition that the ink jetting amount of the inks in the flushing operation is relatively large, the part of the idle suction operation is executed before the print processing, thereby making it possible to suppress any spilling of the ink from the cap 21 during the print processing. On the other hand, under the condition that the predetermined condition is not satisfied, namely under the condition that the ink jetting amount of the inks in the flushing operation is relatively small, the entirety of the idle suction operation is executed after the print processing, thereby making it possible to shift to the print processing more quickly. Note that as the predetermined condition, other than that as described above, it is also possible to adopt a condition such as whether or not the elapsed time elapsed since the full maintenance operation has been executed previous time is not less than a predetermined time. Namely, in a case that the elapsed time is not less than the predetermined time, it is allowable to make the ink jetting amount in the flushing operation to be greater, considering that there is high possibility that the increase in the viscosity of the ink is more progressed than a case that the elapsed time is less than the predetermined time.

Further, in the embodiment, the plurality of nozzles 8 include the plurality of first nozzles and the plurality of second nozzles configured to jet an ink of which kind (color) is different from an ink jetted form the plurality of first nozzles. The cap 21 has the single recessed portion 21*b* capable of covering the plurality of first nozzles and the plurality of second nozzles. In the maintenance processing (full maintenance processing), the controller 60 controls the cap moving device 26 and the pump 24 to thereby activate the pump 24 in the state that the cap 21 makes contact with the nozzle surface 3*a* so as to cover the plurality of nozzles 8. With this, the controller 60 is capable of executing the suction purge operation for sucking the inks from the plurality of first nozzles and the plurality of second nozzle by controlling the pump 24, and is capable of controlling the ink-jet head 3 to thereby execute, as the flushing operation, the post-purge flushing operation for causing the inks to be jetted from the plurality of nozzles 8 toward the recessed portions 21*a* and 21*b*, after the suction purge operation. In a case that such a suction purge operation is executed, there is a fear that there might be any entering of an ink, to each of the first and second nozzles, of which kind is different from the ink jetted from each of the first and second nozzles. However, by executing the post-purge flushing operation, such an entered ink can be discharged out of the nozzles.

Furthermore, in the embodiment, the controller 60 executes, in the maintenance processing (full maintenance processing), the idle suction operation as the discharge operation, after executing the post-purge flushing operation as the nozzle recovery operation. Under the condition that there is the input of the print data to the controller 60 before executing the idle suction operation, the controller 60 executes a part of the idle suction operation before the print processing, and executes a reminder of the idle suction operation after the print processing. In the post-purge flushing operation, the jetting amount of the inks is greater in order to assuredly discharge, from a nozzle, an ink to which another ink of which kind (color) is different from that of the ink enters and mixes, which in turn causes a large amount of the inks to accumulate or remain in the inside of the cap 21 in some cases. In view of this, in a case of executing the post-purge flushing operation, a part of the idle suction operation is executed before the print processing, thereby making it possible to suppress any spilling of the inks from the cap 21 during the print processing.

Moreover, in the embodiment, under a condition that the print data is putted to the controller 60, the controller 60 is capable of controlling the ink-jet head 3 so as to execute, as the flushing operation, the pre-print flushing operation for causing the inks to be jetted from the plurality of nozzles 8 toward the recessed portions 21*a* and 21*b* before the print processing. In a case that the controller 60 executes, in the maintenance processing (full maintenance processing), the idle suction operation as the discharge operation after executing the pre-print flushing operation as the nozzle recovery operation, the controller 60 is configured to execute the entirety of the idle suction operation after the print processing. In the pre-print flushing operation, generally, the ink jetting amount is not much large, and thus there is not any particular problem even if the print processing is executed without executing the idle suction operation. In view of this, in a case of executing the pre-print flushing operation, the entirety of the idle suction operation is executed after the print processing, thereby making it possible to shift to the print processing more quickly.

Furthermore, in the embodiment, the controller 60 is capable of controlling the ink-jet head 3 so as to further execute, as the flushing operation, the periodic flushing operation for referring to the internal clock 65 configured to measure time and for causing the inks to be jetted from the plurality of nozzles 8 toward the recessed portions 21*a* and 21*b* at intervals of the predetermined time Ta1. The controller 60 executes, in the maintenance processing (pre-print maintenance processing), the idle suction operation as the discharge operation, after executing the pre-print flushing operation as the nozzle recovery operation. Under a condition that the controller 60 determines that the non-active time Tc of the internal clock 65 before execution of the pre-print flushing operation is not more than the predetermined time Tc1, the controller 60 causes the inks in a predetermined amount to be jetted from the plurality of nozzles 8 in the pre-print flushing operation, and further executes the entirety of the idle suction operation after the print processing. Under a condition that the controller 60 determines that the non-active time Tc of the internal clock 65 before execution of the pre-print flushing operation is more than the predetermined time Tc1, the controller 60 causes the inks in an amount which is greater than the predetermined amount to be jetted from the plurality of nozzles 8 in the pre-print flushing operation, and further executes the part of the idle suction operation before the print processing, and the controller 60 executes the remainder of the idle suction operation after the print processing. In a case that the non-active time Tc of the internal clock 65 before the execution of the pre-print flushing operation is determined to be not more than the predetermined time Tc1, it is considered that the periodic flushing operation has been periodically executed until then, and there is a low possibility that the increase in viscosity of the inks inside the nozzles 8 is progressed. On the other hand, in a case that the non-active time Tc of the internal clock 65 before the execution of the pre-print flushing operation is determined to be longer (more) than the predetermined time Tc1, it is considered that the periodic flushing operation has not been periodically executed until then, and there is a high possibility that the increase in viscosity of the inks inside the nozzles 8 is progressed. In view of this, in the case that the non-active time Tc of the internal clock 65 before the execution of the pre-print flushing operation is determined to be more than the predetermined time Tc1, it is possible to discharge the inks of which viscosity is increased from the nozzles 8 assuredly, by increasing the ink jetting amount in the pre-print flushing operation. Further, even if the ink jetting amount in the pre-print flushing operation becomes great, the part of the idle suction operation is executed before the print processing, thereby making it possible to suppress any spilling of the ink from the cap 21 during the print processing.

Moreover, in the embodiment, the controller 60 is capable of executing the plurality of kinds of flushing operations (the post-purge flushing operation, the periodic flushing operation, the normal flushing operation (pre-print flushing operation), the extended flushing operation (pre-print flushing operation) which are different from each other in the ink jetting amount thereof. The controller 60 makes the duration time of the idle suction operation executed before the print processing to be longer, as the ink jetting amount in the flushing operation is greater. In a case that the plurality of kinds of flushing operation of which ink jetting amounts are different from each other can be executed, then as the ink jetting amount is greater, the amount of the inks accumulated in the inside of the cap 21 becomes greater. In view of this, as the ink jetting amount in the flushing operation is greater, the duration time of the idle suction operation executed before the print processing is made longer, thereby making it possible to suppress any spilling of the inks from the cap 21 and to shift to the print processing more quickly.

Further, the printer 1 of the embodiment has the cap 21 having, as the receiving section, the first recessed portion (recessed portion 21*a* for black) capable of facing certain nozzles 8 as a part of the plurality of nozzles 8 and the second recessed portion (recessed portion 21*b* for color) capable of facing other nozzles 8 different from the certain nozzles 8 as the part of the plurality of nozzles 8, the cap 21 being capable of making contact with the nozzle surface 3*a* so as to cover the plurality of nozzles 8. The printer 1 of the embodiment is provided with the switching valve 23 which is provided at an intermediate portion, of the connection channel 28, located closer to (on the side of) the cap 21 than the pump 24 and which is configured to switch the communication state of the connection channel 28. The connection channel 28 has the first channel 28*a* connecting the first recessed portion 21*a* and the switching valve 23, the second channel 28*b* connecting the second recessed portion 21*b* and the switching valve 23, the third channels 28*c*, 28*d* connecting the switching valve 23 and the waste-liquid storing section 25 and having the pump 24 disposed at an intermediate portion of the third channel 28*c*, 28*d*, and the fourth channel 28*e* connecting the switching valve 23 and the waste-liquid storing section 25 and open to atmosphere.

The controller 60 executes, as the nozzle recovery operation, the following operations:

The controller 60 causes the cap 21 to make contact with the nozzle surface 3*a* so as to cover the plurality of nozzles 8, controls the switching valve 23 and the pump 24 to activate the pump 24 in a state that the first channel 28*a* and the third channel 28*c*, 28*d* are communicated with each other to thereby suck the ink from the black nozzles 8.

Further, the controller 60 executes the first suction purge operation by controlling the switching valve 23 to communicate the second channel 28*b* and the fourth channel 28*e* with each other to thereby allow the second recessed portion 21*b* to be in the atmosphere-open state in which the second recessed portion 21*b* is open to the atmosphere.

Furthermore, the controller 60 executes the second suction purge operation wherein the controller 60 causes the cap 21 to make contact with the nozzle surface 3*a* so as to cover the plurality of nozzles 8, and controls the switching valve 23 and the pump 24 so as to activate the pump 24 in a state that the second channel 28*b* and the third channel 28*c*, 28*d* are communicated with each other to thereby suck the inks from the color nozzles 8; and the controller 60 controls switching valve 23 so as to communicate the first channel 28*a* and the fourth channel 28*e* with each other to thereby allow the first recessed portion 21*a* to be in the atmosphere-open state in which the first recessed portion 21*a* is open to the atmosphere.

Further, the controller 60 executes, as the discharge operation, the following operations.

The controller 60 executes the channel cleaning operation by controlling the switching valve 23 and the pump 24 so as to activate the pump 24 in a state that the third channel 28*c*, 28*d* and the fourth channel 28*e* are communicated with each other to thereby discharge the inks in the fourth channel 28*e* to the waste-liquid storing section 25.

Further, under a condition that there is the input of the print data to the controller 60 before the controller 60 executes the channel cleaning operation in the maintenance processing, the controller 60 executes the first suction purge operation and the second suction purge operation before the print processing and executes at least a part of the channel cleaning operation after the print processing.

In a case that the first and second suction purge operations are executed, a portion of the inks flowing into the switching valve 23 flow(s) into the fourth channel 28*e*, in some cases. In view of this, by executing the channel cleaning operation of discharging the inks in the fourth channel 28*e* to the waste-liquid storing section 25, it is possible to suppress any remaining and firmly fixing of the inks in the fourth channel 28*e*. In this situation, in a case that there is the input of the print data before the channel cleaning operation is executed in the maintenance processing, the channel cleaning processing can be executed after the print processing is completed, thereby making it possible to shorten or omit the channel cleaning operation which is (to be) executed before the print processing, thus realizing a quick shift to the print processing.

Furthermore, in the embodiment, the printer 1 includes: the conveyance roller 4 configured to convey a recording paper Q; the conveyance motor 42 configured to drive the conveyance roller 4; and the driving force transmission device 43 configured to be capable of switching the driving force transmission-destination, to which driving force from the conveyance motor 42 is transmitted, between the conveyance roller 4 and the pump 24. In a case that the idle suction operation is executed, the driving force transmission device 43 switches the driving force transmission-destination of the driving force of the conveyance motor 42 to the pump 24. In the printer 1 having such a configuration as described above, it is possible to reduce the number of the parts and/or components by using the conveyance motor 42 also as the driving motor for driving the pump 24. However, when the print processing is started, the conveyance motor 42 is used to drive the conveyance roller 4, thus making it impossible to drive the pump 24. Therefore, in the printer which is incapable of executing the print processing and the discharge operation at the same time, the present teaching executing at least a part of the discharge operation after the print processing so as to realize a quick shift to the print processing is particularly effective.

<Other Embodiments>

The present teaching is not limited to the above-described embodiment, and the components and/or parts of the embodiment can be appropriately combined, or a variety of kinds of changes can be made to the present teaching, without departing from the spirit and/or gist of the present teaching.

The above-described full maintenance processing of the present embodiment is executed when the controller 60 receives the maintenance instruction from the user. However, the trigger for executing the full maintenance processing is not limited to the maintenance instruction from the user. For example, the full maintenance processing may be periodically executed per a predetermined time interval. Alternatively, such a configuration is also allowable that when the print data is inputted, the full maintenance processing is executed before the print processing. Further, in this case, when the print data is inputted, determination is also made as to whether or not the elapsed time elapsed since the last time the print processing has been completed exceeds a predetermined time, and only under a condition that the elapsed time exceeds the predetermined time, the full maintenance is executed. Further, the trigger(s) for executing the periodic maintenance processing and/or the pre-print maintenance processing is (are) not limited to that indicated in the embodiment, and any appropriate change can be made.

Further, the flows of the respective maintenance processings are not limited to those indicated in the embodiment; it is allowable to omit a part of the processing, and to add another processing to each of the maintenance processings. Furthermore, it is possible to change the order of (the steps) in each of the processings.

Furthermore, in the embodiment, the cap moving device 26 is configured to function as the "cap switching device" of the present teaching configured to switch the state of the cap 21 between the atmosphere shut-off state and the atmosphere-communication state. However, it is also possible to adopt such a configuration that the cap 21 is provided with an atmosphere communication hole which is different from a suction hole connected to (communicating with) the pump 24, and this atmosphere communication hole is communicated with the atmosphere via a valve. According to such a configuration, even in the state that the cap 21 is located at the contact position, the cap 21 is allowed to have the atmosphere communication state by opening the valve, when in turn makes it possible to execute the idle suction operation and/or the flushing operation. Note that in this case, consequently, the valve functions as the cap switching device configured to switch the state of the cap 21 between the atmosphere shut-off state and the atmosphere-communication state.

Moreover, in the embodiment, the pump 24 is configured to be driven by the conveyance motor 42 configured to drive the conveyance roller 4. However, the configuration for driving the pump 24 is not limited to this. For example, it is allowable to provide such a configuration that the pump 24 is driven by a feed motor configured to drive a pick-up roller which feeds a recording paper Q from a paper feed tray to a print area. Alternatively, a dedicated motor for driving the pump 24 may be provided.

Figure 11:
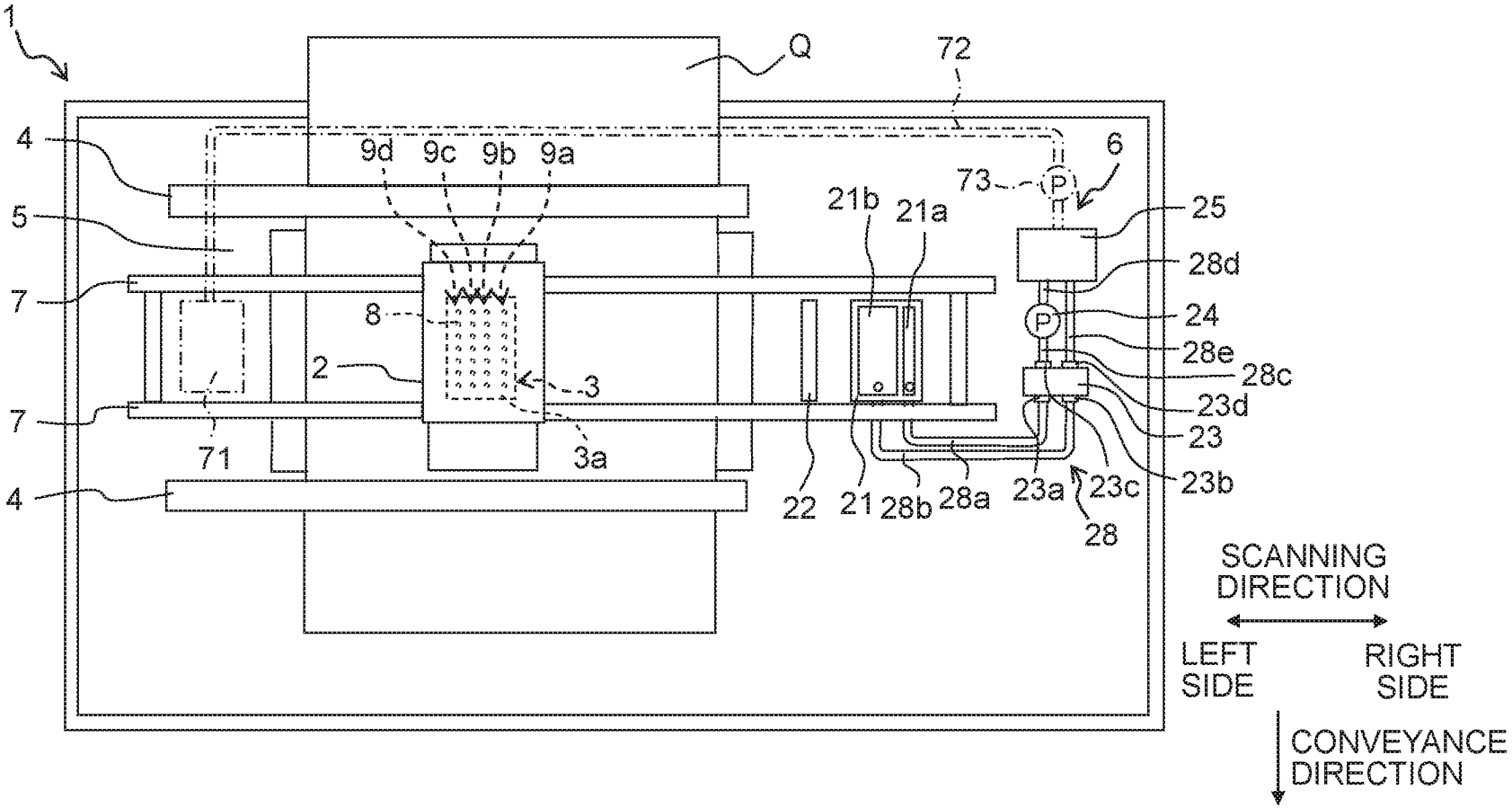
FIG. 11 is a view depicting the schematic configuration of a printer according to another embodiment of the present teaching.

Further, it is also allowable to provide, as in a printer 101 depicted in FIG. 11, such a configuration wherein a flushing receiving section 71 capable of receiving the inks is arranged on a side opposite to the cap 21 with the platen 5 being interposed therebetween, such that a flushing operation for jetting the inks from the plurality of nozzles 8 toward the flushing receiving section 71 can be executed. It is also allowable to connect the flushing receiving section 71 to the waste-liquid storing section 25 by a connecting channel 72 and to provide a pump 73 at an intermediate portion of the connecting channel 72. In this case, the flushing receiving section 71 corresponds to the "receiver" of the present teaching. Further, it is also allowable to execute, as the "nozzle recovery operation" of the present teaching, a flushing operation for jetting the inks from the plurality of nozzles 8 toward the flushing receiving section 71; and to execute, as the "discharge operation" of the present teaching, a processing for sucking the inks present in at least one of the flushing receiving section 71 and the connecting channel 72 by the pump 73 and for discharging the sucked inks to the waste-liquid storing section 25. Note that it is allowable to use a part of the connecting channel 72 and the pump 73 also as a part of the connecting channel 28 and the pump 24, respectively.

Furthermore, in the embodiment, the flushing operation and the idle suction operation are executed in a non-overlapping manner. It is allowable, however, that the pump 24 is driven during the execution of the flushing operation to thereby execute a part of the idle suction operation concurrently with the flushing operation.

Moreover, in the embodiment, the present teaching is applied to the printer 1 configured to perform printing by jetting the inks from the nozzles 8 toward the recording paper Q. However, the object to which the present teaching is applicable is not limited to this. For example, the present teaching may be applied to a printer, device, etc., configured to perform printing on an object different from the recording paper Q (for example, a can, a bottle, etc.) by discharging an ink onto such an object, or to a printer, device, etc., configured to jet a wiring pattern of a wiring board (liquid for a pattern material) onto a substrate of the wiring board.

What is claimed is:

1. A printer comprising:

a liquid jetting head having a plurality of nozzles;

a receiver;

a waste-liquid storage;

a connection channel connecting the receiver and the waste-liquid storage;

a pump provided on the connection channel at an intermediate portion thereof; and a controller configured to control the liquid jetting head and the pump to execute:

printing based on a print data input to the controller;

recovering the plurality of nozzles by discharging the liquid from the plurality of nozzles toward the receiver; and discharging the liquid, which is present in at least one of the receiver and the connection channel, to the waste-liquid storage without discharging the liquid from the plurality of nozzles, wherein under a condition that there is an input of the print data to the controller before the discharging of the liquid to the waste-liquid storage, the controller controls the liquid jetting head to start the printing after the recovering of the plurality of nozzles and then the controller controls the pump to execute at least a part of the discharging of the liquid in at least one of the receiver and the connection channel to the waste-liquid storage without discharging the liquid from the plurality of nozzles.

2. The printer according to claim 1, wherein under a condition that there is no input of the print data to the controller before the discharging of the liquid to the waste-liquid storage, the controller controls the liquid jetting head to execute maintenance including the recovering the plurality of nozzles and the discharging of the liquid to the waste-liquid storage.

3. The printer according to claim 1, wherein the controller is configured to execute second discharging in which the liquid present in at least one of the receiver and the connection channel is discharged to the waste-liquid storage, wherein during a period in which the recovering the plurality of nozzles is executed, the controller controls the pump to execute the second discharging of the liquid to the waste-liquid storage.

4. The printer according to claim 1, wherein under the condition that there is the input of the print data to the controller before the discharging of the liquid to the waste-liquid storage, the controller controls the pump to execute entirety of the discharging of the liquid to the waste-liquid storage after the printing.

5. The printer according to claim 1, wherein under the condition that there is the input of the print data to the controller before the discharging of the liquid to the waste-liquid storage, the controller controls the pump to execute the part of the discharging of the liquid to the waste-liquid storage before the printing and to execute a reminder of the discharging of the liquid to the waste-liquid storage after the printing.

6. The printer according to claim 1, wherein the receiver includes:

a cap having a recessed portion, the cap being contactable with the liquid jetting head such that the recessed portion covers the plurality of nozzles; and a cap switching device configured to switch a state of the cap between an atmosphere shut-off state in which a space defined by the recessed portion and the liquid jetting head is sealed without communicating with an outside of the cap, and an atmosphere-communication state in which the recessed portion communicates with the outside of the cap;

wherein in a case that the discharging of the liquid to the waste-liquid storage is executed, the controller controls the pump and the cap switching device to execute an idle suction operation in which the pump is activated in the atmosphere-communication state to discharge the liquid inside the recessed portion, and wherein under a condition that there is the input of the print data to the controller before the idle suction operation, the controller controls the liquid jetting head to execute the printing after the recovering of the plurality of nozzles, and then controls the pump and the cap switching device to execute at least a part of the idle suction operation after the printing.

7. The printer according to claim 6, wherein in a case that the recovering of the plurality of nozzles is executed, the controller controls the liquid jetting head to execute a flushing operation in which the liquid is jetted from the plurality of nozzles toward the recessed portion.

8. The printer according to claim 7, wherein under a condition that a predetermined condition is satisfied, the controller controls the liquid jetting head to execute the flushing operation with a liquid jetting amount of the liquid greater than that under a condition that the predetermined condition is not satisfied; and the controller controls the pump and the cap switching device to:

execute the part of the idle suction operation before the printing and execute a reminder of the idle suction operation after the printing, under a condition that there is the input of the print data to the controller before the idle suction operation and that the predetermined condition is satisfied, and execute entirety of the idle suction operation after the printing, under a condition that there is the input of the print data to the controller before the idle suction operation and that the predetermined condition is not satisfied.

9. The printer according to claim 7, wherein the plurality of nozzles includes a plurality of first nozzles for jetting first liquid and a plurality of second nozzles for jetting second liquid which is different from the first liquid;

wherein the recessed portion of the cap is a single recessed portion capable of covering the plurality of first nozzles and the plurality of second nozzles;

wherein the cap switching device includes a cap moving device configured to move the cap between a contact position at which the cap makes contact with the liquid jetting head and a separate position at which the cap is separated from the liquid jetting head; and wherein the controller is configured to control:

the pump and the cap switching device to execute a suction purge operation in which the pump is activated to suck the liquid from the plurality of first nozzles and the plurality of second nozzles, in the state that the cap makes contact with the liquid jetting head to cover the plurality of nozzles, and the liquid jetting head to execute, as the flushing operation, a post-purge flushing operation in which the liquid is jetted from the plurality of nozzles to the recessed portion, after the suction purge operation.

10. The printer according to claim 9, wherein in the case that the recovering of the plurality of nozzles is executed, the controller controls the pump and the cap switching device to execute the idle suction operation after the post-purge flushing operation; and under the condition that there is the input of the print data to the controller before the idle suction operation, the controller controls the pump and the cap switching device to execute the part of the idle suction operation before the printing, and to execute a reminder of the idle suction operation after the printing.

11. The printer according to claim 7, wherein under a condition that the print data is input to the controller, the controller controls the liquid jetting head to execute, as the flushing operation, a pre-print flushing operation in which the liquid is jetted from the plurality of nozzles toward the recessed portion, before the printing; and wherein in a case that the idle suction operation is executed after the pre-print flushing operation, the controller controls the pump and the cap switching device to execute entirety of the idle suction operation after the printing.

12. The printer according to claim 11, further comprising an internal clock, wherein the controller is configured to:

control the liquid jetting head to execute, as the flushing operation, a periodic flushing operation in which the liquid is jetted from the plurality of nozzles toward the recessed portion in a plurality of times at intervals of a predetermined time;

control the pump and the cap switching device to execute the idle suction operation after the pre-print flushing operation;

under a condition that the controller determines that a non-active time of the internal clock before the pre-print flushing operation is not more than the predetermined time, control the liquid jetting head to execute jetting a predetermined amount of the liquid from the plurality of nozzles in the pre-print flushing operation, and further control the pump and the cap switching device to execute the entirety of the idle suction operation after the printing; and under a condition that the controller determines that the non-active time of the internal clock before the pre-print flushing operation is more than the predetermined time, control the liquid jetting head to execute jetting an amount, of the liquid, which is greater than the predetermined amount from the plurality of nozzles in the pre-print flushing operation, and further control the pump and the cap switching device to execute the part of the idle suction operation before the printing and execute a remainder of the idle suction operation after the printing.

13. The printer according to claim 7, wherein the controller is configured to control the liquid jetting head to execute, as the flushing operation, a plurality of kinds of flushing operations which are different from each other in a liquid jetting amount thereof; and the controller is configured to make a duration time of the idle suction operation executed before the printing to be longer, as the liquid jetting amount in the flushing operation is greater.

14. The printer according to claim 1, wherein the receiver includes a cap having a first recessed portion facing certain nozzles as a part of the plurality of nozzles and a second recessed portion facing other nozzles different from the certain nozzles as the part of the plurality of nozzles, the cap being contactable with the liquid jetting head to cover the plurality of nozzles;

wherein the printer further comprises a switching valve which is provided at an intermediate portion, of the connection channel, located closer to the cap than the pump, wherein the connection channel includes:

a first channel connecting the first recessed portion and the switching valve, a second channel connecting the second recessed portion and the switching valve, a third channel connecting the switching valve and the waste-liquid storing section, wherein the pump is arranged at an intermediate portion of the third channel, and a fourth channel connecting the switching valve and the waste-liquid storing section, wherein the fourth channel is open to atmosphere;

wherein in a case that the recovering of the plurality of nozzles is executed, the controller controls the liquid jetting head, the pump and the switching valve to execute a first suction purge operation and a second suction purge operation, wherein the first suction purge operation includes:

causing the cap to make contact with the liquid jetting head to cover the plurality of nozzles, controlling the switching valve and the pump to activate the pump in a state that the first channel and the third channel are communicated with each other to thereby execute sucking the liquid from the certain nozzles as the part of the plurality of nozzles, controlling the switching valve to communicate the second channel and the fourth channel with each other to thereby allow the second recessed portion to be in an atmosphere-open state in which the second recessed portion is open to the atmosphere; and wherein the second suction purge operation includes:

causing the cap to make contact with the liquid jetting head to cover the plurality of nozzles, controlling the switching valve and the pump to activate the pump in a state that the second channel and the third channel are communicated with each other to thereby execute sucking the liquid from the other nozzles, and controlling the switching valve to communicate the first channel and the fourth channel with each other to thereby allow the first recessed portion to be in the atmosphere-open state in which the first recessed portion is open to the atmosphere;

wherein in a case that the discharging of the liquid to the waste-liquid storing section is executed, the controller controls the switching valve and the pump to activate the pump in a state that the third channel and the fourth channel are communicated with each other to thereby execute discharging the liquid in the fourth channel to the waste-liquid storing section; and wherein under a condition that there is the input of the print data to the controller before the discharging of the liquid inside the fourth channel to the waste-liquid storing section, the controller controls the liquid jetting head, the pump and the switching valve to execute the first suction purge operation and the second suction purge operation before the printing and to execute at least a part of the discharging the liquid in the fourth channel to the waste-liquid storing section after the printing.

15. The printer according to claim 1, further comprising:

a conveyance roller configured to convey a print medium;

a motor for driving the conveyance roller; and a driving force switching device configured to switch a destination of driving force of the motor between the conveyance roller and the pump, wherein in a case that the discharging of the liquid to the waste-liquid storing section is executed, the controller controls the driving force switching device to switch the destination of the driving force of the motor to the pump.

* * * * *